US011074921B2

(12) United States Patent
Chinen et al.

(10) Patent No.: US 11,074,921 B2
(45) Date of Patent: Jul. 27, 2021

(54) INFORMATION PROCESSING DEVICE AND INFORMATION PROCESSING METHOD

(71) Applicant: SONY CORPORATION, Tokyo (JP)

(72) Inventors: Toru Chinen, Kanagawa (JP); Minoru Tsuji, Chiba (JP); Yuki Yamamoto, Tokyo (JP)

(73) Assignee: SONY CORPORATION, Tokyo (JP)

( * ) Notice: Subject to any disclaimer, the term of this patent is extended or adjusted under 35 U.S.C. 154(b) by 9 days.

(21) Appl. No.: 16/488,136

(22) PCT Filed: Mar. 15, 2018

(86) PCT No.: PCT/JP2018/010165
§ 371 (c)(1),
(2) Date: Aug. 22, 2019

(87) PCT Pub. No.: WO2018/180531
PCT Pub. Date: Oct. 4, 2018

(65) Prior Publication Data

US 2020/0043505 A1 Feb. 6, 2020

(30) Foreign Application Priority Data

Mar. 28, 2017 (JP) ..... JP2017-062305

(51) Int. Cl.
*G10L 19/008* (2013.01)
*H04S 3/00* (2006.01)
*H04S 7/00* (2006.01)

(52) U.S. Cl.
CPC ..... *G10L 19/008* (2013.01); *H04S 3/008* (2013.01); *H04S 7/302* (2013.01); *H04S 7/305* (2013.01); *H04S 2400/11* (2013.01)

(58) Field of Classification Search
CPC ..... H04S 2420/11; H04S 2420/01; H04S 2420/00; H04S 2420/03; H04S 3/008;
(Continued)

(56) References Cited

U.S. PATENT DOCUMENTS

2005/0114121 A1* 5/2005 Tsingos et al. ..... G10L 19/10 704/220
2005/0249367 A1 11/2005 Bailey
(Continued)

FOREIGN PATENT DOCUMENTS

AR 079517 A1 2/2012
AU 2010332934 A1 7/2012
(Continued)

OTHER PUBLICATIONS

Extended European Search Report of EP Application No. 18774689.6, dated Mar. 16, 2020, 06 pages.
(Continued)

*Primary Examiner* — Leshui Zhang
(74) *Attorney, Agent, or Firm* — Chip Law Group

(57) ABSTRACT

The present technology relates to an information processing device and an information processing method that enable reduction of an amount of data to be transmitted in transmission of data of a plurality of audio objects. An information processing device according to one aspect of the present technology combines audio objects with sounds that are undistinguishable at a predetermined supposed listening position among a plurality of audio objects for the predetermined supposed listening position among a plurality of supposed listening positions and transmits data of a combined audio object obtained by the combination, along with data of other audio objects with sounds that are distinguishable at the predetermined supposed listening position. The present technology can be applied to a device that can process object-based audio data.

12 Claims, 20 Drawing Sheets

(58) Field of Classification Search
CPC . H04S 7/00; H04S 7/302; H04S 7/305; H04S 7/30; H04S 3/006; H04S 3/02; H04S 5/00; H04S 5/005; H04S 5/02; H04S 7/301; H04S 7/303; H04S 7/304; H04S 7/306; H04S 7/307; H04S 7/308; H04S 7/40; H04S 2400/00; H04S 2400/01; H04S 2400/03; H04S 2400/05; H04S 2400/07; H04S 2400/09; H04S 2400/11; H04S 2400/13; H04S 2400/15; G10L 19/008; G06F 3/165
USPC ..... 704/500; 381/17, 19, 20, 21, 22, 23, 381/309, 310, 74.103; 700/94
See application file for complete search history.

(56) References Cited

U.S. PATENT DOCUMENTS

| | | | | |
|---|---|---|---|---|
| 2010/0145487 | A1* | 6/2010 | Oh et al. ..... | G06F 17/00 700/94 |
| 2013/0016842 | A1 | 1/2013 | Schultz-Amling et al. | |
| 2014/0023196 | A1 | 1/2014 | Xiang et al. | |
| 2014/0023197 | A1* | 1/2014 | Xiang et al. ..... | H04S 1/00 381/17 |
| 2014/0025386 | A1 | 1/2014 | Xiang et al. | |
| 2016/0142846 | A1 | 5/2016 | Herre et al. | |
| 2016/0192105 | A1* | 6/2016 | Breebaart et al. ..... | H04S 7/00 381/303 |
| 2017/0223476 | A1 | 8/2017 | Breebaart et al. | |

FOREIGN PATENT DOCUMENTS

| | | | |
|---|---|---|---|
| CA | 2784862 | A1 | 6/2011 |
| CN | 102859584 | A | 1/2013 |
| CN | 104471640 | A | 3/2015 |
| CN | 105431900 | A | 3/2016 |
| CN | 105593930 | A | 5/2016 |
| EP | 2346028 | A1 | 7/2011 |
| EP | 2502228 | A1 | 9/2012 |
| EP | 2830045 | A1 | 1/2015 |
| EP | 3028273 | A1 | 6/2016 |
| ES | 2592217 | T3 | 11/2016 |
| FR | 2862799 | A1 | 5/2005 |
| HK | 1176733 | A1 | 7/2017 |
| JP | 5426035 | B2 | 2/2014 |
| JP | 2016-528542 | A | 9/2016 |
| JP | 2016-530803 | A | 9/2016 |
| KR | 10-2012-0089369 | A | 8/2012 |
| KR | 10-2015-0038156 | A | 4/2015 |
| KR | 10-2016-0021892 | A | 2/2016 |
| KR | 10-2016-0053910 | A | 5/2016 |
| KR | 10-1646867 | B1 | 8/2016 |
| KR | 10-2016-0140971 | A | 12/2016 |
| RU | 2012132354 | A | 1/2014 |
| RU | 2016106913 | A | 9/2017 |
| TW | 201146026 | A | 12/2011 |
| WO | 2011/073210 | A1 | 6/2011 |
| WO | 2014/015299 | A1 | 1/2014 |
| WO | 2015/011024 | A1 | 1/2015 |
| WO | 2015/017235 | A1 | 2/2015 |
| WO | 2018/047667 | A1 | 3/2018 |

OTHER PUBLICATIONS

International Search Report and Written Opinion of PCT Application No. PCT/JP2018/010165, dated May 15, 2018, 10 pages of ISRWO.

* cited by examiner

INFORMATION PROCESSING DEVICE AND INFORMATION PROCESSING METHOD

CROSS REFERENCE TO RELATED APPLICATIONS

This application is a U.S. National Phase of International Patent Application No. PCT/JP2018/010165 filed on Mar. 15, 2018, which claims priority benefit of Japanese Patent Application No. JP 2017-062305 filed in the Japan Patent Office on Mar. 28, 2017. Each of the above-referenced applications is hereby incorporated herein by reference in its entirety.

TECHNICAL FIELD

The present technology relates to an information processing device, an information processing method, and a program, and in particular relates to an information processing device, an information processing method, and a program that enable reduction of an amount of data to be transmitted in transmission of data of a plurality of audio objects.

BACKGROUND ART

Free-viewpoint video technologies have drawn attention as efforts of video technologies. There is a technology of combining images captured by a plurality of cameras from multiple directions to thereby retain a target object as a moving image of a point cloud, and generate a video according to a direction or distance from which the target object is viewed (NPL 1).

Once viewing of a video from a free-viewpoint is realized, people start having a demand about sounds also, demanding to listen sounds that make them feel as if they are at the place of the viewpoint. In view of this, in recent years, object-based audio technologies are drawing attention. Object-based audio data is reproduced by rendering based on metadata on waveform data of each audio object into signals of a desired number of channels depending on a system on the reproduction side.

CITATION LIST

Non Patent Literature

[NPL 1]

The web site of University of Tsukuba, "HOMETSUKUBA FUTURE-#042: Customizing Sports Events with Free-Viewpoint Video," [Retrieved: Mar. 22, 2017], <URL: http://www.tsukuba.ac.jp/notes/042/index.html>

SUMMARY

Technical Problem

In transmission of object-based audio data, the larger the number of audio objects to be transmitted is, the larger the data transmission amount is.

The present technology has been made in view of such a situation, and an object thereof is to enable reduction of an amount of data to be transmitted in transmission of data of a plurality of audio objects.

Solution to Problem

An information processing device according to one aspect of the present technology includes: a combining unit that combines audio objects with sounds that are undistinguishable at a predetermined supposed listening position from among a plurality of audio objects for the predetermined supposed listening position among a plurality of supposed listening positions; and a transmitting unit that transmits data of a combined audio object obtained by the combination, along with data of other audio objects with sounds that are distinguishable at the predetermined supposed listening position.

Based on audio waveform data and rendering parameters of a plurality of audio objects to be targets of the combination, the combining unit can be caused to generate audio waveform data and a rendering parameter of the combined audio object.

The transmitting unit can be caused to transmit, as the data of the combined audio object, the audio waveform data and the rendering parameter that are generated by the combining unit, and to transmit, as the data of the other audio objects, audio waveform data of each of the other audio objects and a rendering parameter for the predetermined supposed listening position.

The combining unit can be caused to combine a plurality of audio objects at positions that are away from the predetermined supposed listening position by distances which are equal to or longer than a predetermined distance.

The combining unit can be caused to combine a plurality of audio objects that is within a horizontal angle range narrower than a predetermined angle as measured from the predetermined supposed listening position as a reference position.

The combining unit can be caused to combine audio objects with sounds that are undistinguishable at the predetermined supposed listening position and belong to a same preset group.

The combining unit can be caused to perform audio object combination such that the number of audio objects to be transmitted becomes the number corresponding to a transmission bit rate.

The transmitting unit can be caused to transmit an audio bitstream including flag information representing whether an audio object included in the audio bitstream is an uncombined audio object or the combined audio object.

The transmitting unit can be caused to transmit an audio bitstream file along with a reproduction management file including flag information representing whether an audio object included in the audio bitstream is an uncombined audio object or the combined audio object.

In one aspect of the present technology, audio objects with sounds that are undistinguishable at a predetermined supposed listening position are combined from among a plurality of audio objects for the predetermined supposed listening position among a plurality of supposed listening positions; and data of a combined audio object obtained by the combination is transmitted along with data of other audio objects with sounds that are distinguishable at the predetermined supposed listening position.

Advantageous Effect of Invention

The present technology enables reduction of an amount of data to be transmitted in transmission of data of a plurality of audio objects.

Note that advantages of the present technology are not necessarily limited to the advantage described here, but may be any one of advantages described in the present disclosure.

DESCRIPTION OF EMBODIMENTS

Hereinafter, embodiments for carrying out the present technology are explained. Explanations are given in the following order:

1. Configuration of Transmission System
2. Manner of Merging Objects
3. Exemplary Configuration of Each Device
4. Operations of Each Device
5. Modification Examples of Manner of Merging Objects
6. Modification Examples <<Configuration of Transmission System>>

Figure 1:
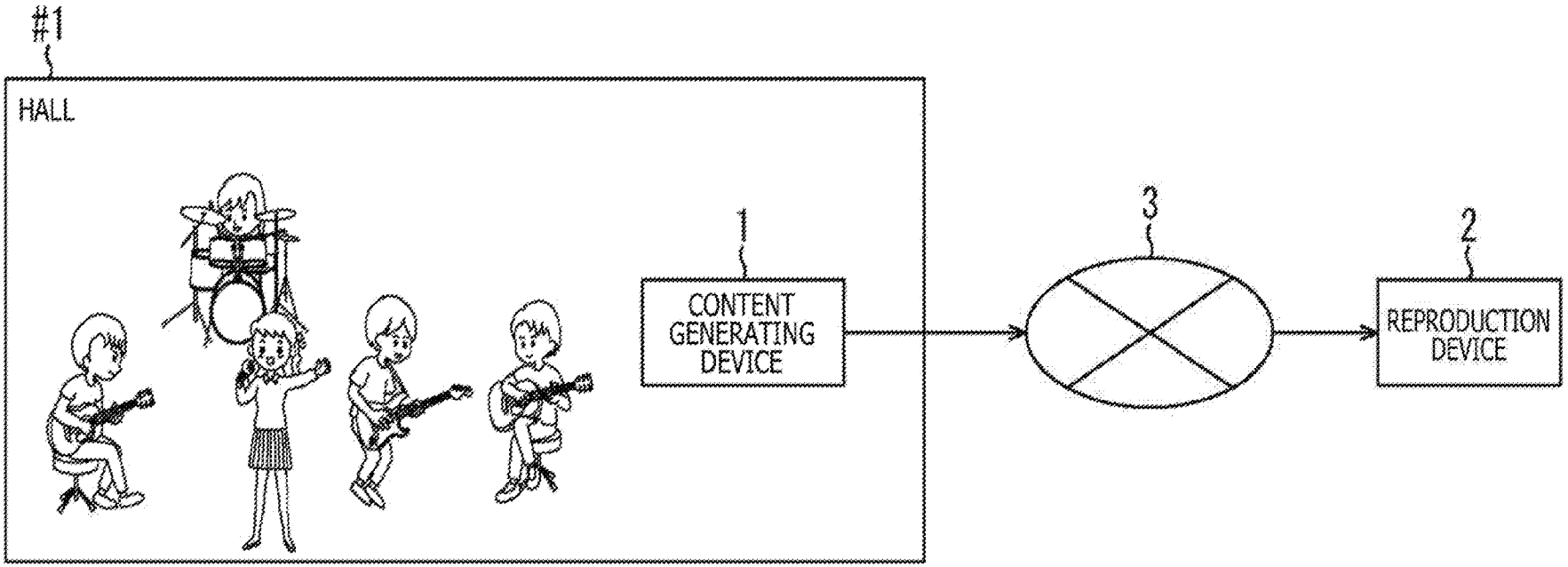
FIG. 1 is a figure illustrating an exemplary configuration of a transmission system according to one embodiment of the present technology.

FIG. 1 is a figure illustrating an exemplary configuration of a transmission system according to one embodiment of the present technology.

The transmission system illustrated in FIG. 1 is constituted by a content generating device 1 and a reproduction device 2 being connected via the Internet 3.

The content generating device 1 is a device managed by a content creator, and is installed at a hall #1 where a live music performance is underway. Contents generated by the content generating device 1 are transmitted to the reproduction device 2 via the Internet 3. Content distribution may be performed via a server which is not illustrated.

On the other hand, the reproduction device 2 is a device installed in the home of a user who views and listens to contents of the live music performance generated by the content generating device 1. Although only the reproduction device 2 is illustrated as a reproduction device to which contents are distributed in the example illustrated in FIG. 1, there are actually many reproduction devices connected to the Internet 3.

Video contents generated by the content generating device 1 are a video for which one can switch the viewpoint. In addition, sound contents also are sounds for which one can switch the viewpoint (supposed listening position) such that the listening position matches the position of the video viewpoint, for example. If the viewpoint is switched, the positioning of sounds is switched.

Sound contents are prepared as object-based audio data. Audio data included in contents includes audio waveform data of each audio object, and rendering parameters as metadata for positioning the sound source of each audio object. Hereinafter, audio objects are simply called objects, as appropriate.

A user of the reproduction device 2 can select any viewpoint from a plurality of viewpoints that are prepared, and view and listen to contents through a video and sounds according to the viewpoint.

The content generating device 1 provides the reproduction device 2 with contents including video data of a video as seen from the viewpoint selected by the user, and object-based audio data of the viewpoint selected by the user. For example, such object-based audio data is transmitted in a form of data compressed in a predetermined manner such as MPEG-H 3D Audio.

Note that MPEG-H 3D Audio is disclosed at "ISO/IEC 23008-3: 2015 "Information technology—High efficiency coding and media delivery in heterogeneous environments—Part 3: 3D audio," <https://www.iso.org/standard/63878.html>."

Hereinafter, mainly processes related to audio data are explained. As illustrated in FIG. 1, the live music performance that is underway in the hall #1 is a live performance where five people play a bass, drums, a guitar 1 (main guitar), a guitar 2 (side guitar), and a vocal on a stage. Treating each of the bass, drums, guitar 1, guitar 2, and vocal as an object, audio waveform data of each object, and rendering parameters for each viewpoint are generated at the content generating device 1.

Figure 2A:
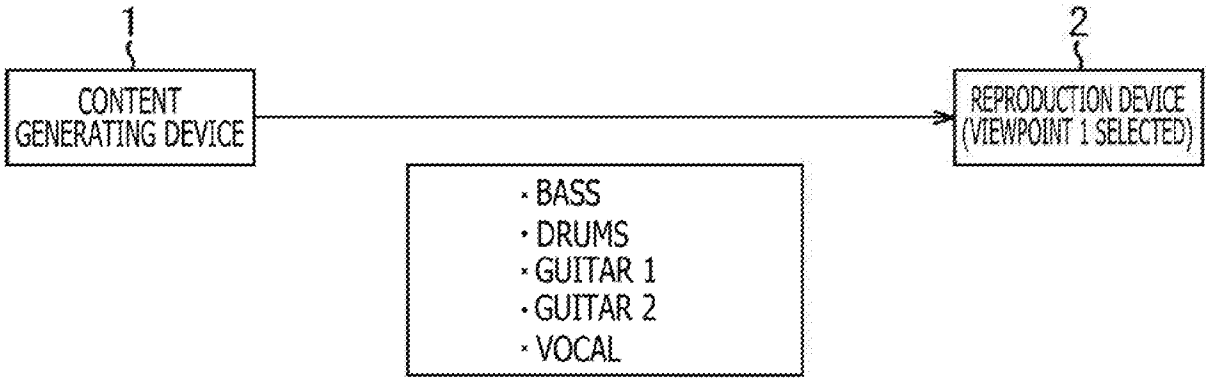
FIGS. 2A and 2B are figures illustrating exemplary types of objects to be transmitted.
Figure 2B:
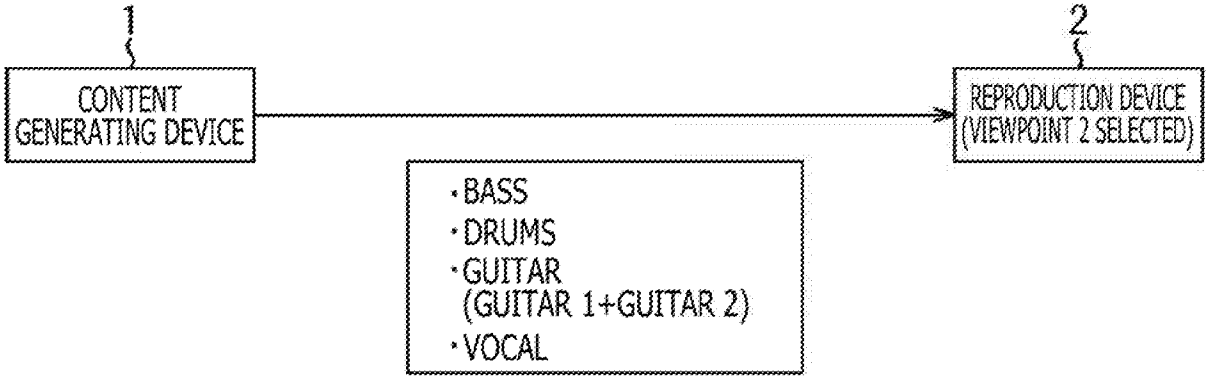

FIGS. 2A and 2B are figures illustrating exemplary types of objects to be transmitted from the content generating device 1.

For example, if a viewpoint 1 is selected from a plurality of viewpoints by the user, data of five types of objects, the bass, drums, guitar 1, guitar 2, and vocal, is transmitted as illustrated in FIG. 2A. The transmitted data includes audio waveform data of each of the objects, the bass, drums, guitar 1, guitar 2, and vocal, and rendering parameters of each object for the viewpoint 1.

In addition, if the viewpoint 2 is selected by the user, the guitar 1 and the guitar 2 are merged into one object of a guitar, and data of four types of objects, the bass, drums, guitar, and vocal is transmitted as illustrated in FIG. 2B. The transmitted data includes audio waveform data of each of the objects, the bass, drums, guitar, and vocal, and rendering parameters of each object for the viewpoint 2.

The viewpoint 2 is set to a position where sounds of the guitar 1 and sounds of the guitar 2 are undistinguishable by the human auditory sense since they come from the same direction, for example. In this manner, objects with sounds that are undistinguishable at a viewpoint selected by the user are merged, and transmitted as data of a single merged object.

By merging objects and transmitting them as data of a merged object as appropriate according to a selected viewpoint, it becomes possible to reduce the data transmission amount.

<<Manner of Merging Objects>>

Here, a manner of merging objects is explained.

(1) It is supposed that there is a plurality of objects. Audio waveform data of objects is defined as:

x(n, i) i=0, 1, 2, . . . , L-1 n is a time index. In addition, i represents the type of an object. Here, the number of objects is L.

(2) It is supposed that there is a plurality of viewpoints. Rendering information about objects corresponding to each viewpoint is defined as:

r(i, j) j=0, 1, 2, . . . , M-1 j represents the type of a viewpoint. The number of viewpoints is M.

(3) Audio data y(n, j) corresponding to each viewpoint is represented by Math (1):

[Math. 1]

$$y(n, j) = \sum_{i=0}^{L-1} x(n, i) * r(i, j) \tag{1}$$

Here, it is supposed that rendering information r is a gain (gain information). In this case, the value range of rendering information r is 0 to 1. Audio data for each viewpoint is represented by the sum of audio waveform data of all the objects, a piece of audio waveform data of each object being multiplied by a gain. A calculation like the one illustrated by Math (1) is performed at the reproduction device 2.

(4) A plurality of objects with sounds that is undistinguishable at a viewpoint are transmitted as merged data. For example, objects that are far from a viewpoint, and within a predetermined horizontal angular range from the viewpoint are selected as objects with undistinguishable sounds. On the other hand, nearby objects with distinguishable sounds at a viewpoint are not merged, but are transmitted as independent objects.

(5) Rendering information about an object corresponding to each viewpoint is defined by the type of the object, the position of the object, and the position of the viewpoint as: r(obj_type, obj_loc_x, obj_loc_y, obj_loc_z, lis_loc_x, lis_loc_y, lis_loc_z)

obj_type is information indicating the type of the object, and indicates the type of a musical instrument, for example.

obj_loc_x, obj_loc_y, and obj_loc_z are information indicating the position of the object in a three-dimensional space.

lis_loc_x, lis_loc_y, and lis_loc_z are information indicating the position of the viewpoint in the three-dimensional space.

For objects that are transmitted independently, such parameter information constituted by obj_type, obj_loc_x, obj_loc_y, obj_loc_z, lis_loc_x, lis_loc_y, and lis_loc_z is transmitted along with rendering information r. Rendering parameters are constituted by parameter information and rendering information.

Hereinafter, specific explanations are given.

Figure 3:
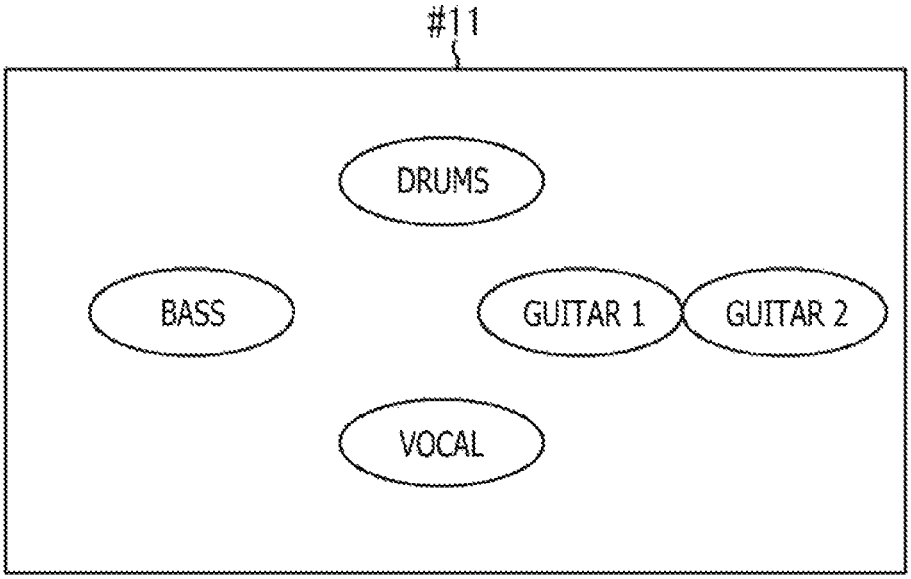
FIG. 3 is a plan view illustrating an exemplary arrangement of each object.

(6) For example, each of the objects, the bass, drums, guitar 1, guitar 2, and vocal, is arranged as illustrated in FIG. 3. FIG. 3 is a top view of a stage #11 in the hall #1.

Figure 4:
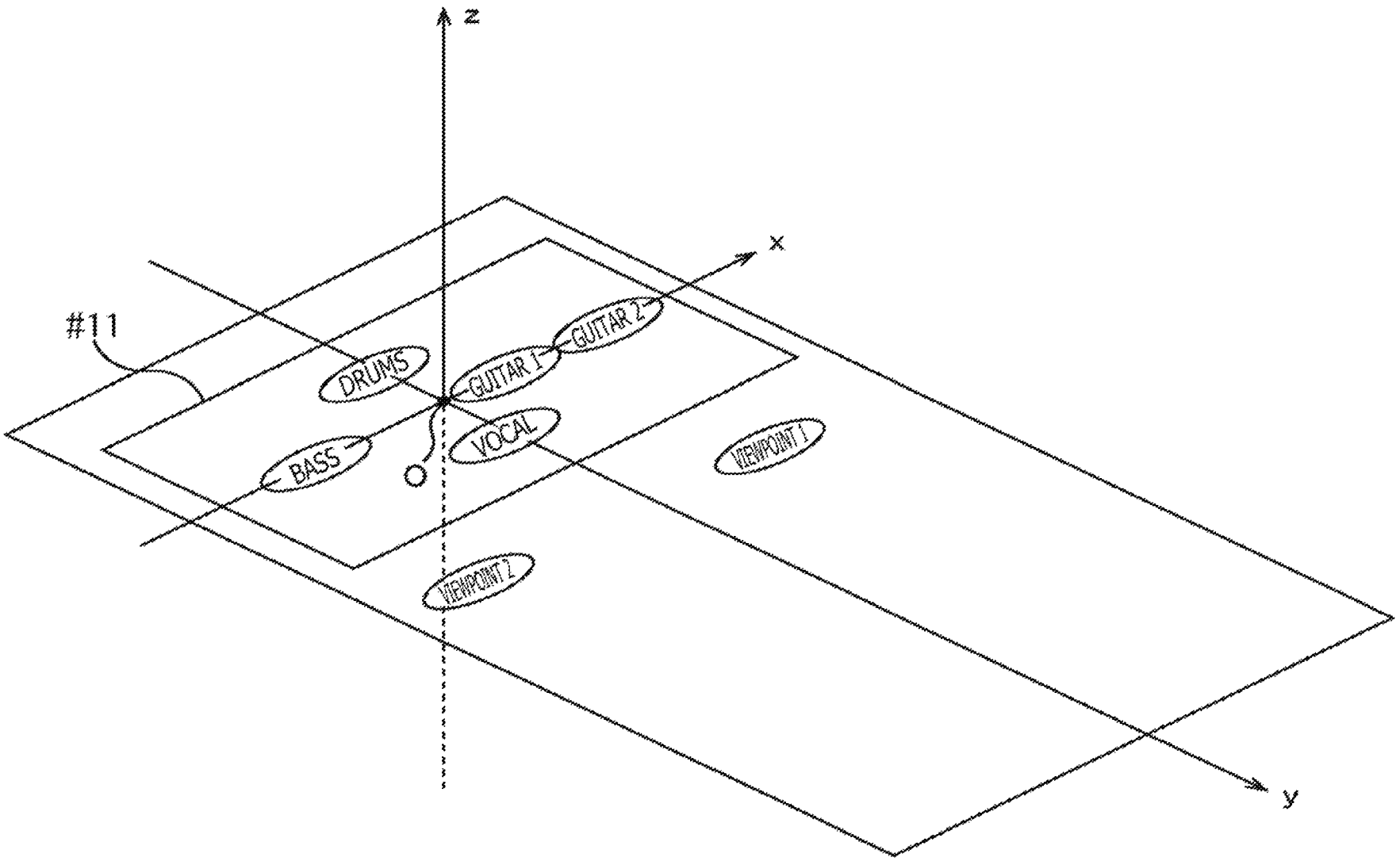
FIG. 4 is an oblique view of a hall.

(7) Axes X, Y, and Z are set for the hall #1 as illustrated in FIG. 4. FIG. 4 is an oblique view of the entire hall #1 including the stage #11 and seats. The origin O is the center position on the stage #11. A viewpoint 1 and a viewpoint 2 are set in the seats.

The coordinate of each object is represented as follows in meters:

Coordinate of the bass: x=−20, y=0, and z=0
Coordinate of the drums: x=0, y=−10, and z=0
Coordinate of the guitar 1: x=20, y=0, and z=0
Coordinate of the guitar 2: x=30, y=0, and z=0
Coordinate of the vocal: x=0, y=10, and z=0

(8) The coordinate of each viewpoint is represented as follows:

Viewpoint 1: x=25, y=30, and z=−1
Viewpoint 2: x=−35, y=30, and z=−1

Note that the positions of each object and each viewpoint in the figure represent merely an image of positional relations, and are not positions accurately reflecting each of the numerical values explained above.

(9) At this time, rendering information about each object for the viewpoint 1 is represented as follows:

Rendering information about the bass:
r(0, −20, 0, 0, 25, 30, −1)
Rendering information about the drums:
r(1, 0, −10, 0, 25, 30, −1)
Rendering information about the guitar 1:
r(2, 20, 0, 0, 25, 30, −1)
Rendering information about the guitar 2:
r(3, 30, 0, 0, 25, 30, −1)
Rendering information about the vocal:
r(4, 0, 10, 0, 25, 30, −1)
obj_type of each object assumes the following values.
Bass: obj_type=0
Drums: obj_type=1
Guitar 1: obj_type=2
Guitar 2: obj_type=3
Vocal: obj_type=4

For the viewpoint 2 also, rendering parameters including parameter information and rendering information represented in the manner mentioned above is generated at the content generating device 1.

(10) Based on Math (1) illustrated above, audio data in the case where the viewpoint 1 (j=0) is selected is represented by Math (2):

[Math. 2]

$$y(n,0)=x(n,0)*r(0,-20,0,0,25,30,-1)+x(n,1)*r(1,0,-10,0,25,30,-1)+x(n,2)*r(2,20,0,0,25,30,-1)+x(n,3)*r(3,30,0,0,25,30,-1)+x(n,4)*r(4,0,10,0,25,30,-1) \tag{2}$$

Figure 5A:
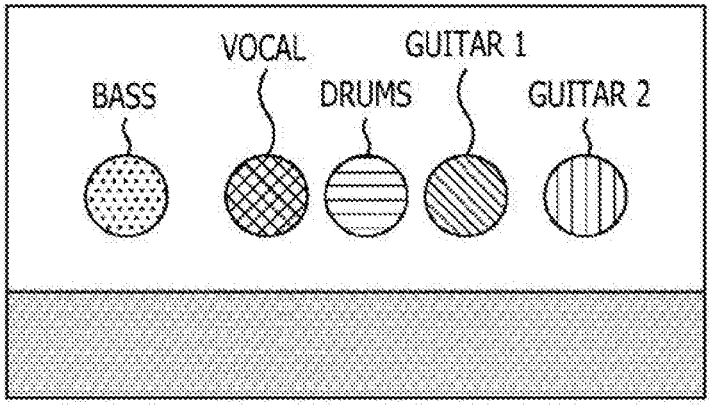
FIGS. 5A and 5B are front views illustrating an exemplary arrangement of each object.

It should be noted, however, that i represents the following objects in x(n, i):

i=0: object of the bass
i=1: object of the drums
i=2: object of the guitar 1
i=3: object of the guitar 2
i=4: object of the vocal An exemplary arrangement of respective objects as seen from the viewpoint 1 is illustrated in FIG. 5A. In FIG. 5A, the lower portion indicated by a pale color illustrates a side surface of the stage #11. This is similar also to other figures.

(11) Similarly, audio data in the case where the viewpoint (j=1) is selected is represented by Math (3):

[Math. 3]

$$y(n,1)=x(n,0)*r(0,-20,0,0,-35,30,-1)+x(n,1)*r(1,0,-10,0,-35,30,-1)+x(n,2)*r(2,20,0,0,-35,30,-1)+x(n,3)*r(3,30,0,0,-35,30,-1)+x(n,4)*r(4,0,10,0,-35,30,-1) \quad (3)$$

Figure 5B:
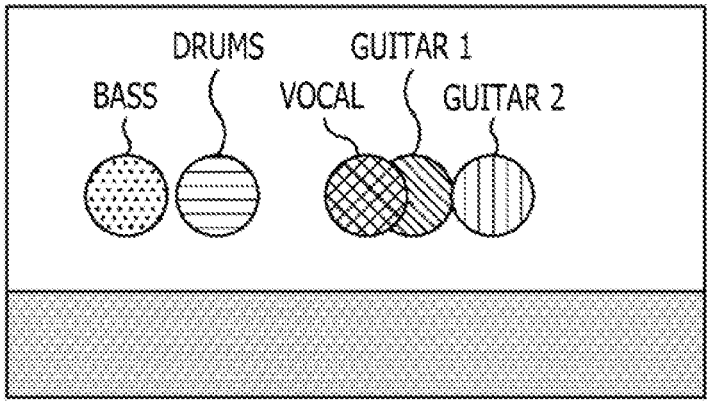

An exemplary arrangement of respective objects as seen from the viewpoint 2 is illustrated in FIG. 5B.

Figure 6:
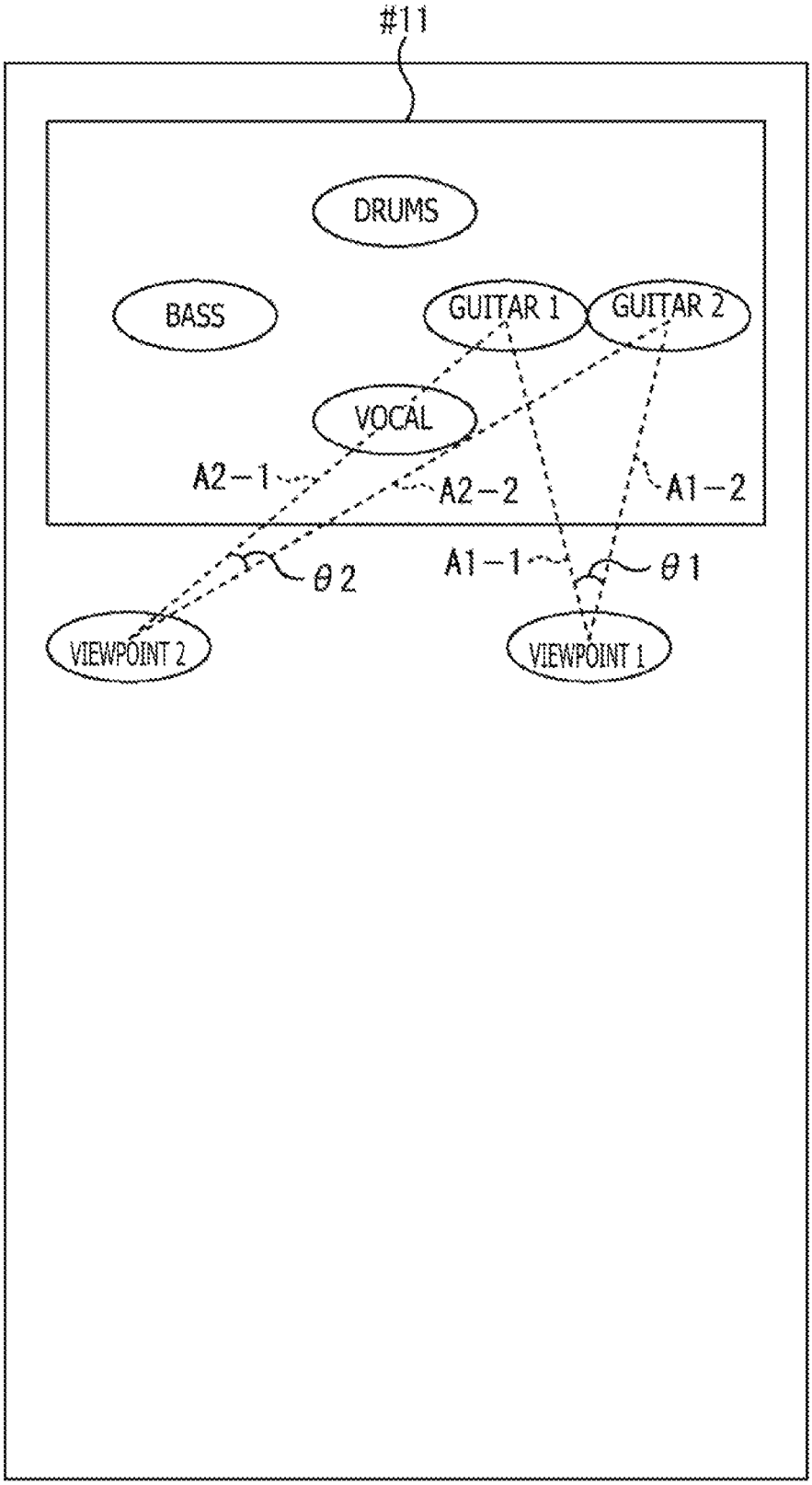
FIG. 6 is a plan view illustrating an exemplary arrangement of each object.

(12) Here, as illustrated in FIG. 6, the angle θ1 which is a horizontal angle formed by the direction of the guitar 1 and the direction of the guitar 2 as seen from the viewpoint 1 as the reference position is different from the angle θ2 which is a horizontal angle formed by the direction of the guitar 1 and the direction of the guitar 2 as seen from the viewpoint 2 as the reference position. The angle θ2 is narrower than the angle θ1.

FIG. 6 is a plan view illustrating a positional relation between each object and viewpoints. The angle θ1 is an angle between a broken line A1-1 connecting the viewpoint 1 and the guitar 1 and a broken line A1-2 connecting the viewpoint 1 and the guitar 2. In addition, the angle θ2 is an angle between a broken line A2-1 connecting the viewpoint 2 and the guitar 1 and a broken line A2-2 connecting the viewpoint 2 and the guitar 2.

(13) The angle θ1 is deemed to be an angle that allows the human auditory sense to distinguish sounds, that is, an angle that allows the human auditory sense to identify a sound of the guitar 1 and a sound of the guitar 2 as sounds that come from different directions. On the other hand, the angle θ2 is deemed to be an angle that does not allow the human auditory sense to distinguish sounds. At this time, audio data of the viewpoint 2 can be replaced using Math (4):

[Math. 4]

$$y(n,1)=x(n,0)*r(0,-20,0,0,-35,30,-1)+x(n,1)*r(1,0,-10,0,-35,30,-1)\ x(n,5)*r(5,25,0,0,-35,30,-1)\ x(n,4)*r(3,0,10,0,-35,30,-1) \quad (4)$$

In Math (4), x (n, 5) is represented by Math (5):

[Math. 5]

$$x(n,5)=x(n,2)+x(n,3) \quad (5)$$

That is, Math (5) represents audio waveform data of one object which is obtained by merging the guitar 1 and the guitar 2 as the sum of audio waveform data of the guitar 1 and audio waveform data of the guitar 2. obj_type of the one combined object obtained by merging the guitar 1 and the guitar 2 is obj_type=5.

In addition, for example, rendering information about the combined object is represented by Math (6) as the average of rendering information about the guitar 1 and rendering information about the guitar 2:

[Math. 6]

$$r(5,25,0,0,-35,30,-1)=(r(2,20,0,0,-35,30,-1)+r(3,30,0,0,-35,30,-1))/2 \quad (6)$$

Figure 7:
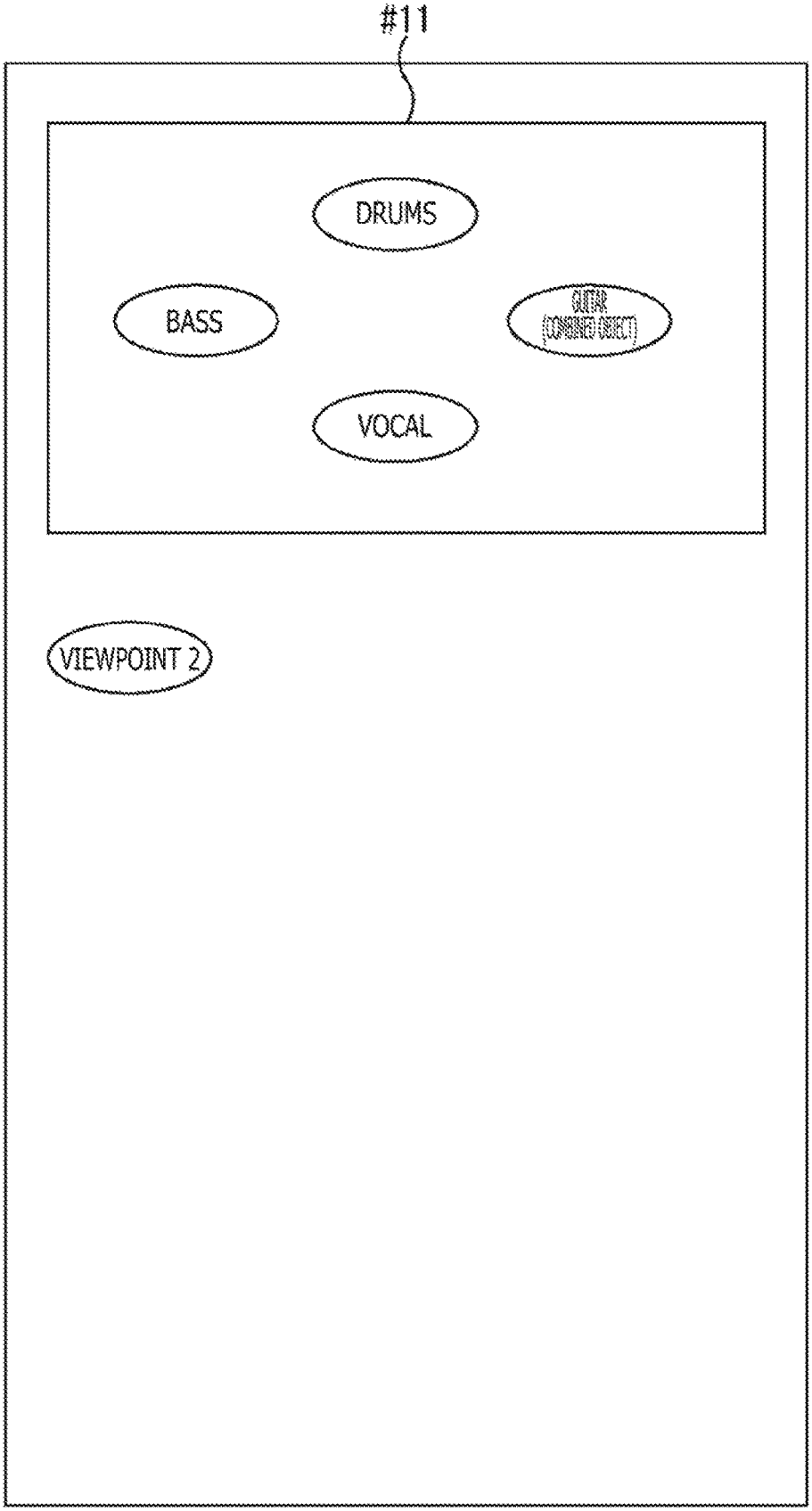
FIG. 7 is a plan view illustrating an exemplary arrangement of each object including a combined object.

In this manner, the combined object represented as obj_type=5 corresponds to audio waveform data x(n, 5), and is subjected to processing using rendering information r(5, 25, 0, 0, −35, 30, −1). An exemplary arrangement of respective objects in the case where the guitar 1 and the guitar 2 are merged into one object is illustrated in FIG. 7.

Figure 8:
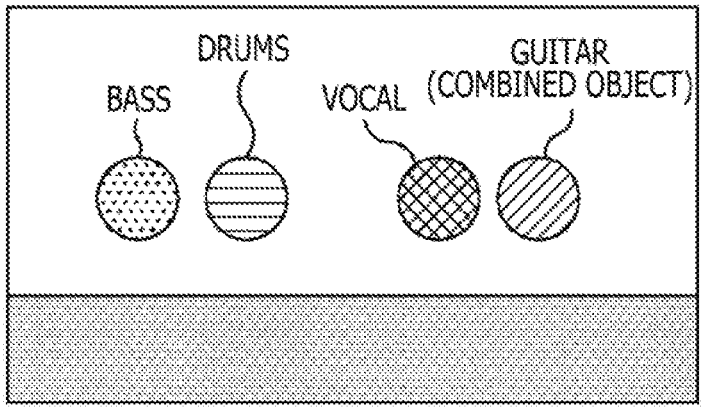
FIG. 8 is a front view illustrating an exemplary arrangement of each object including a combined object.

An exemplary arrangement of respective objects including the combined object as seen from the viewpoint 2 is illustrated in FIG. 8. Although a video as seen from the viewpoint 2 presents images of the guitar 1 and the guitar 2 respectively, only one guitar is arranged as an audio object.

(14) In this manner, objects that are auditorily undistinguishable at a selected viewpoint are merged, and transmitted as single-object data.

Thereby, the content generating device 1 can reduce the number of objects for which data is transmitted, and can reduce the data transmission amount. In addition, since the number of objects to be subjected to rendering is small, the reproduction device 2 can reduce the amount of calculation required for rendering.

Note that although there is the vocal as an object which is within the horizontal angle range of the angle θ2 as seen from the viewpoint 2 other than the guitar 1 and the guitar 2 in the example of FIG. 6, the vocal is an object that is close to the viewpoint 2, and is distinguishable from the guitar 1 and the guitar 2.

<<Exemplary Configuration of Each Device>>

<Configuration of Content Generating Device 1>

Figure 9:
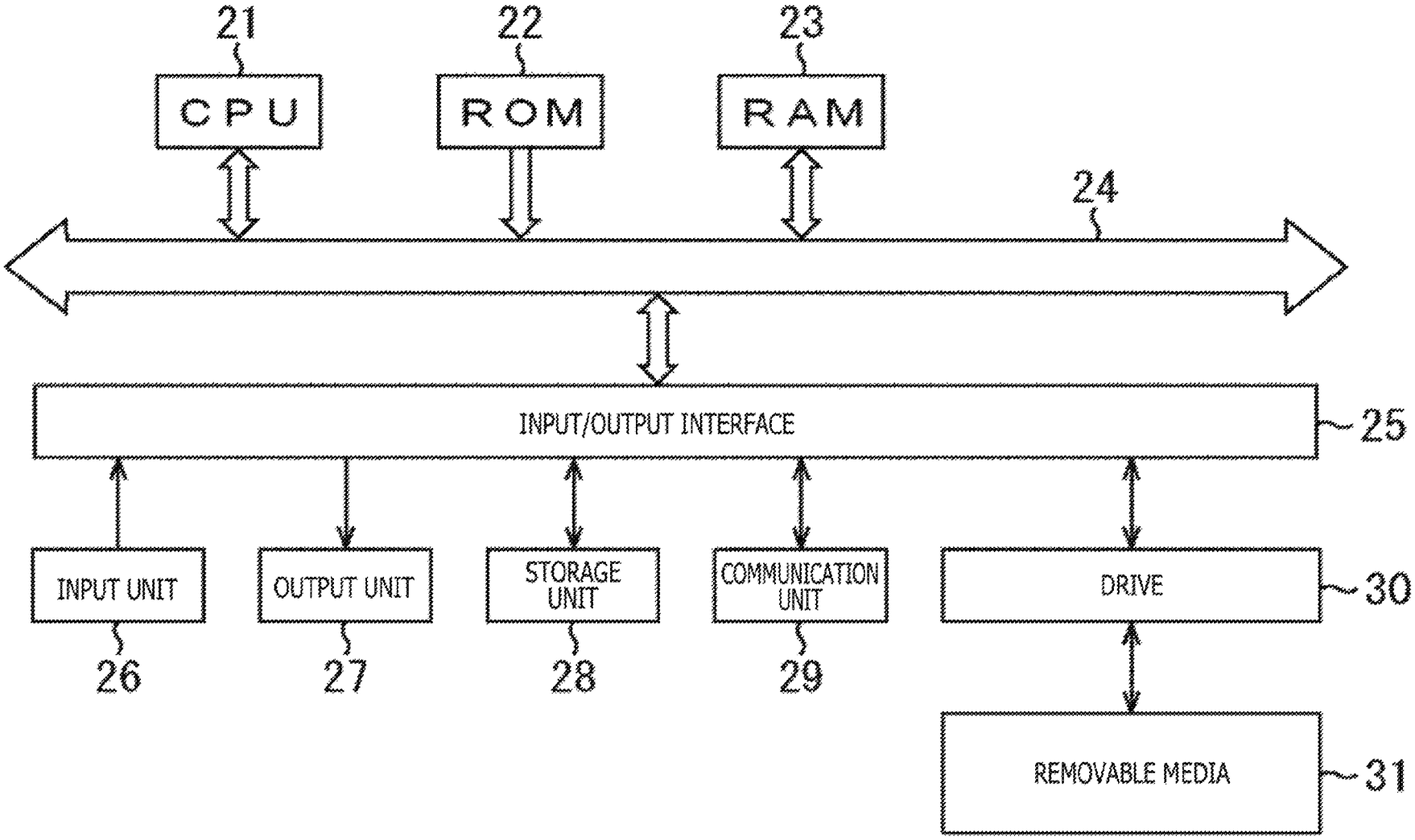
FIG. 9 is a block diagram illustrating an exemplary configuration of a content generating device.

FIG. 9 is a block diagram illustrating an exemplary configuration of the content generating device 1.

A CPU (Central Processing Unit) 21, a ROM (Read Only Memory) 22, and a RAM (Random Access Memory) 23 are interconnected by a bus 24. The bus 24 is further connected with an input/output interface 25. The input/output interface 25 is connected with an input unit 26, an output unit 27, a storage unit 28, a communication unit 29, and a drive 30.

The input unit 26 is constituted by a keyboard, a mouse, and the like. The input unit 26 outputs signals representing contents of manipulation by a user.

The output unit 27 is constituted by a display such as an LCD (Liquid Crystal Display) or an organic EL display, and a speaker.

The storage unit 28 is constituted by a hard disk, a non-volatile memory, and the like. The storage unit 28 stores various types of data such as programs to be executed by the CPU 21, and contents.

The communication unit 29 is constituted by a network interface and the like, and performs communication with an external device via the Internet 3.

The drive 30 writes data in an attached removable media 31, and reads out data recorded in the removable media 31.

The reproduction device 2 also has a configuration which is the same as the configuration illustrated in FIG. 9. Hereinafter, explanations are given by referring to the configuration illustrated in FIG. 9 as the configuration of the reproduction device 2 as appropriate.

Figure 10:
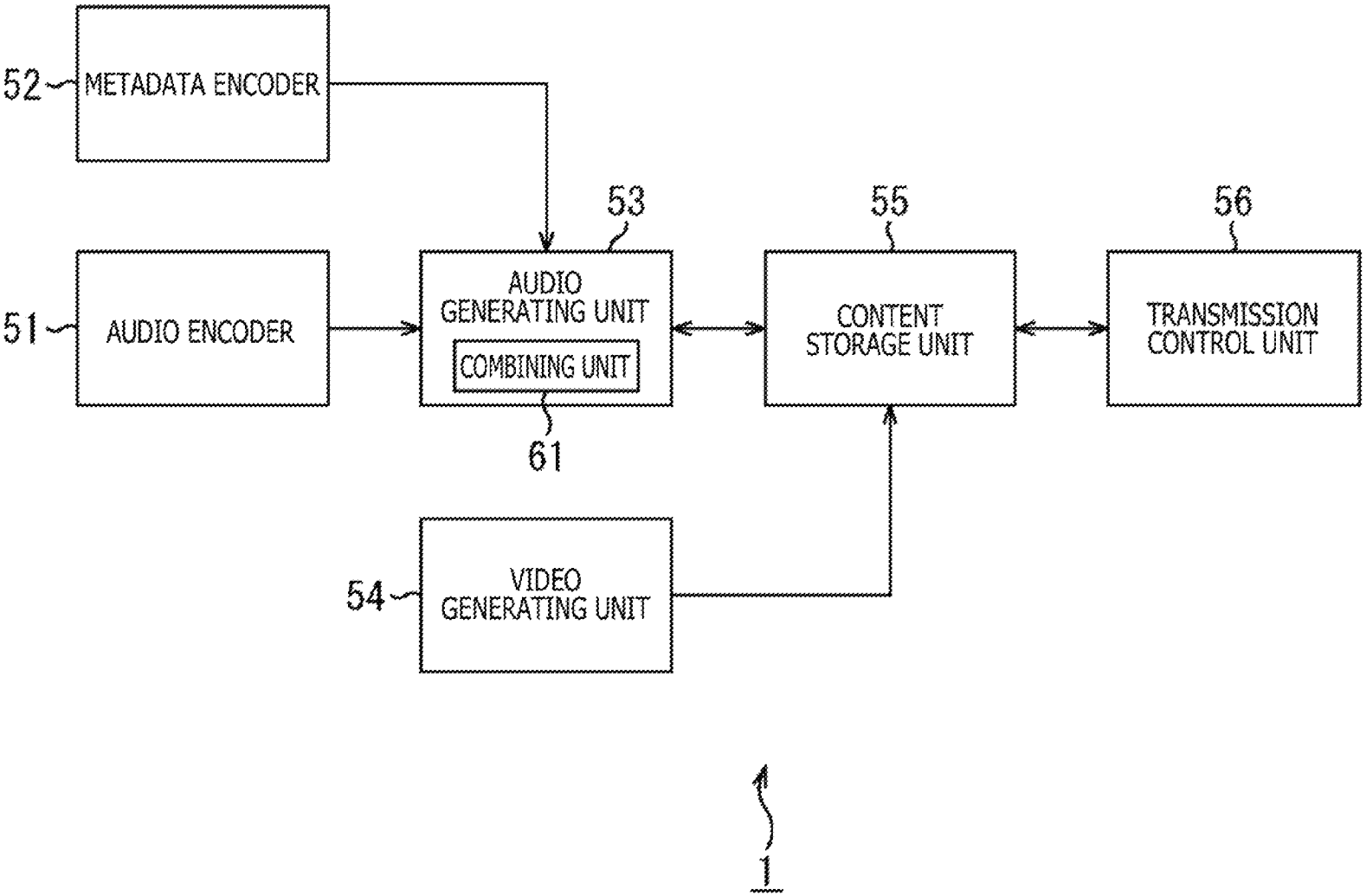
FIG. 10 is a block diagram illustrating an exemplary functional configuration of the content generating device.

FIG. 10 is a block diagram illustrating an exemplary functional configuration of the content generating device 1.

At least part of the configuration illustrated in FIG. 10 is realized by the CPU 21 in FIG. 9 executing a predetermined program. In the content generating device 1, an audio encoder 51, a metadata encoder 52, an audio generating unit 53, a video generating unit 54, a content storage unit 55, and a transmission control unit 56 are realized.

The audio encoder 51 acquires sound signals in a live music performance collected by a microphone (not illustrated), and generates audio waveform data of each object.

The metadata encoder 52 generates rendering parameters of each object for each viewpoint according to manipulation by a content creator. Rendering parameters for each of a plurality of viewpoints set in the hall #1 are generated by the metadata encoder 52.

The audio generating unit 53 associates audio waveform data generated by the audio encoder 51 with rendering parameters generated by the metadata encoder 52 to thereby generate object-based audio data for each viewpoint. The audio generating unit 53 outputs the generated audio data for each viewpoint to the content storage unit 55.

In the audio generating unit 53, a combining unit 61 is realized. The combining unit 61 performs combination of objects, as appropriate. For example, the combining unit 61 reads out audio data for each viewpoint stored in the content storage unit 55, combines objects that can be combined, and stores audio data obtained by the combination in the content storage unit 55.

The video generating unit 54 acquires data of a video captured by a camera installed at the position of each viewpoint, and encode the data in a predetermined encoding manner to thereby generate video data for each viewpoint. The video generating unit 54 outputs the generated video data for each viewpoint to the content storage unit 55.

The content storage unit 55 stores the audio data for each viewpoint generated by the audio generating unit 53 and the video data for each viewpoint generated by the video generating unit 54 in association with each other.

The transmission control unit 56 controls the communication unit 29, and performs communication with the reproduction device 2. The transmission control unit 56 receives selection viewpoint information which is information representing a viewpoint selected by a user of the reproduction device 2, and sends, to the reproduction device 2, contents consisting of video data and audio data corresponding to the selected viewpoint.

<Configuration of Reproduction Device 2>

Figure 11:
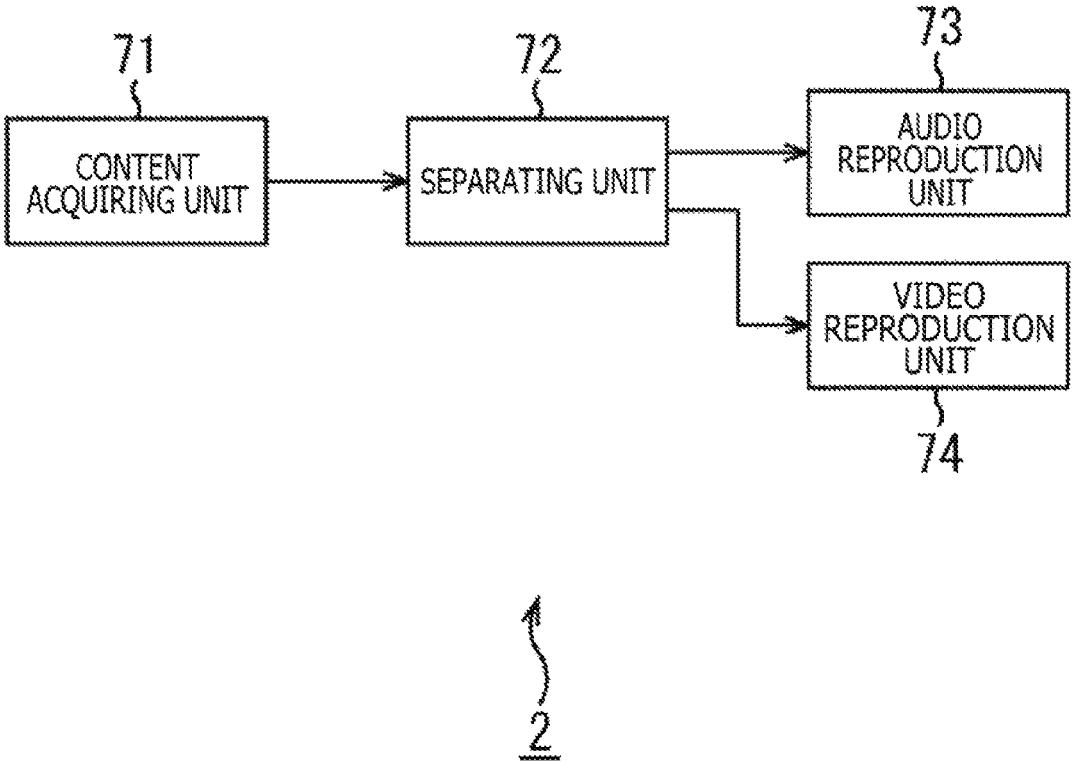
FIG. 11 is a block diagram illustrating an exemplary functional configuration of a reproduction device.

FIG. 11 is a block diagram illustrating an exemplary functional configuration of the reproduction device 2.

At least part of the configuration illustrated in FIG. 11 is realized by the CPU 21 in FIG. 9 executing a predetermined program. In the reproduction device 2, a content acquiring unit 71, a separating unit 72, an audio reproduction unit 73, and a video reproduction unit 74 are realized.

If a viewpoint is selected by a user, the content acquiring unit 71 controls the communication unit 29, and sends selection viewpoint information to the content generating device 1. The content acquiring unit 71 receives and acquires contents sent from the content generating device 1 in response to the sending of the selection viewpoint information. The content generating device 1 sends contents including video data and audio data corresponding to the viewpoint selected by a user. The content acquiring unit 71 outputs the acquired contents to the separating unit 72.

The separating unit 72 separates video data and audio data included in the contents supplied from the content acquiring unit 71. The separating unit 72 outputs the video data of the contents to the video reproduction unit 74, and outputs the audio data of the contents to the audio reproduction unit 73.

Based on rendering parameters, the audio reproduction unit 73 performs rendering of audio waveform data constituting the audio data supplied from the separating unit 72, and makes sound contents output from a speaker constituting the output unit 27.

The video reproduction unit 74 decodes the video data supplied from the separating unit 72, and makes a video of contents as seen from a predetermined viewpoint displayed on a display constituting the output unit 27.

The speaker and display that are used in reproducing contents may be prepared as external equipment connected to the reproduction device 2.

<<Operations of Each Device>>

Next, operations of the content generating device 1 and reproduction device 2 having configurations like the ones mentioned above are explained.

<Operations of Content Generating Device 1>

Content Generation Process

First, processes performed by the content generating device 1 to generate contents are explained with reference to the flowchart illustrated in FIG. 12.

Figure 12:
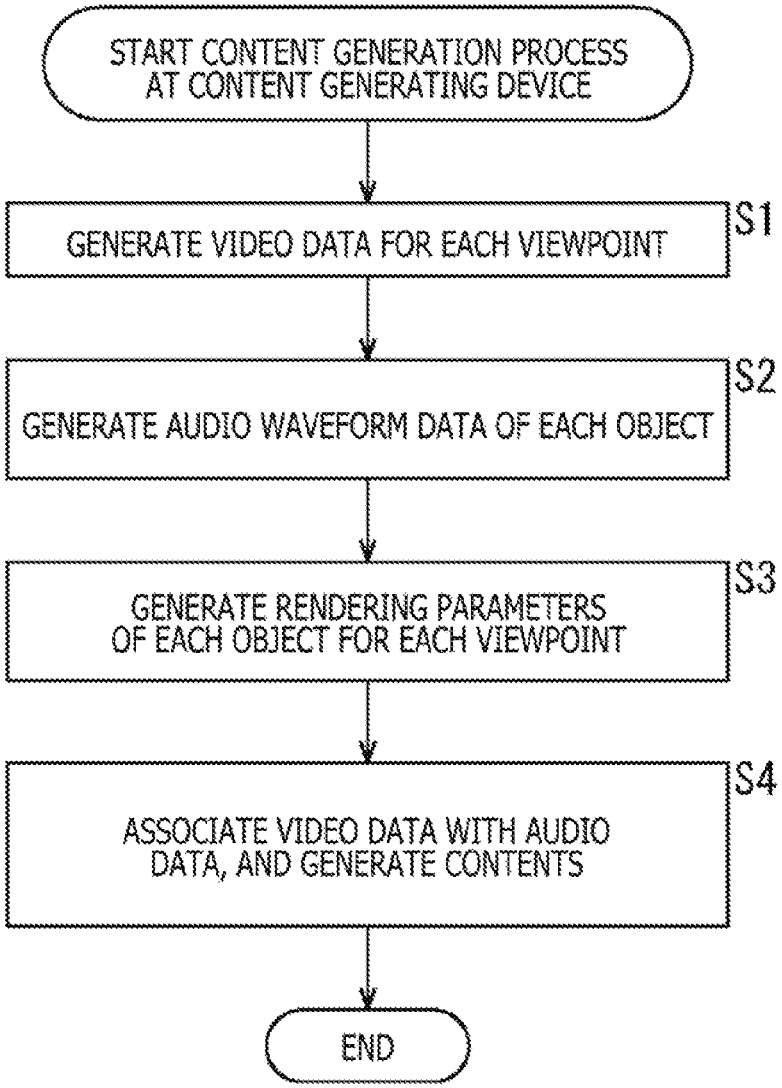
FIG. 12 is a flowchart for explaining a content generation process performed by the content generating device.

The processes illustrated in FIG. 12 are started, for example, when a live music performance is started and video data for each viewpoint and sound signals of each object are input to the content generating device 1.

A plurality of cameras is installed in the hall #1, and videos captured by those cameras are input to the content generating device 1. In addition, microphones are installed near each object in the hall #1, and sound signals acquired by those microphones are input to the content generating device 1.

At Step S1, the video generating unit 54 acquires data of a video captured by a camera for each viewpoint, and generates a video data for each viewpoint.

At Step S2, the audio encoder 51 acquires sound signals of each object, and generates audio waveform data of each object. In the example mentioned above, audio waveform data of each of the objects, the bass, drums, guitar 1, guitar 2 and vocal, is generated.

At Step S3, the metadata encoder 52 generates rendering parameters of each object for each viewpoint according to manipulation by a content creator.

For example, if the viewpoint 1 and the viewpoint 2 are set in the hall #1 as mentioned above, a set of rendering parameters of each of the objects, the bass, drums, guitar 1, guitar 2, and vocal, for the viewpoint 1, and a set of rendering parameters of each of the objects, the bass, drums, guitar 1, guitar 2, and vocal, for the viewpoint 2 are generated.

At Step S4, the content storage unit 55 associates audio data with video data for each viewpoint to thereby generate and store contents for each viewpoint.

The processes mentioned above are performed repeatedly while the live music performance is underway. For example, when the live music performance ended, the processes of FIG. 12 are ended.

Object Combination Processes

Next, processes performed by the content generating device 1 to combine objects are explained with reference to the flowchart illustrated in FIG. 13.

Figure 13:
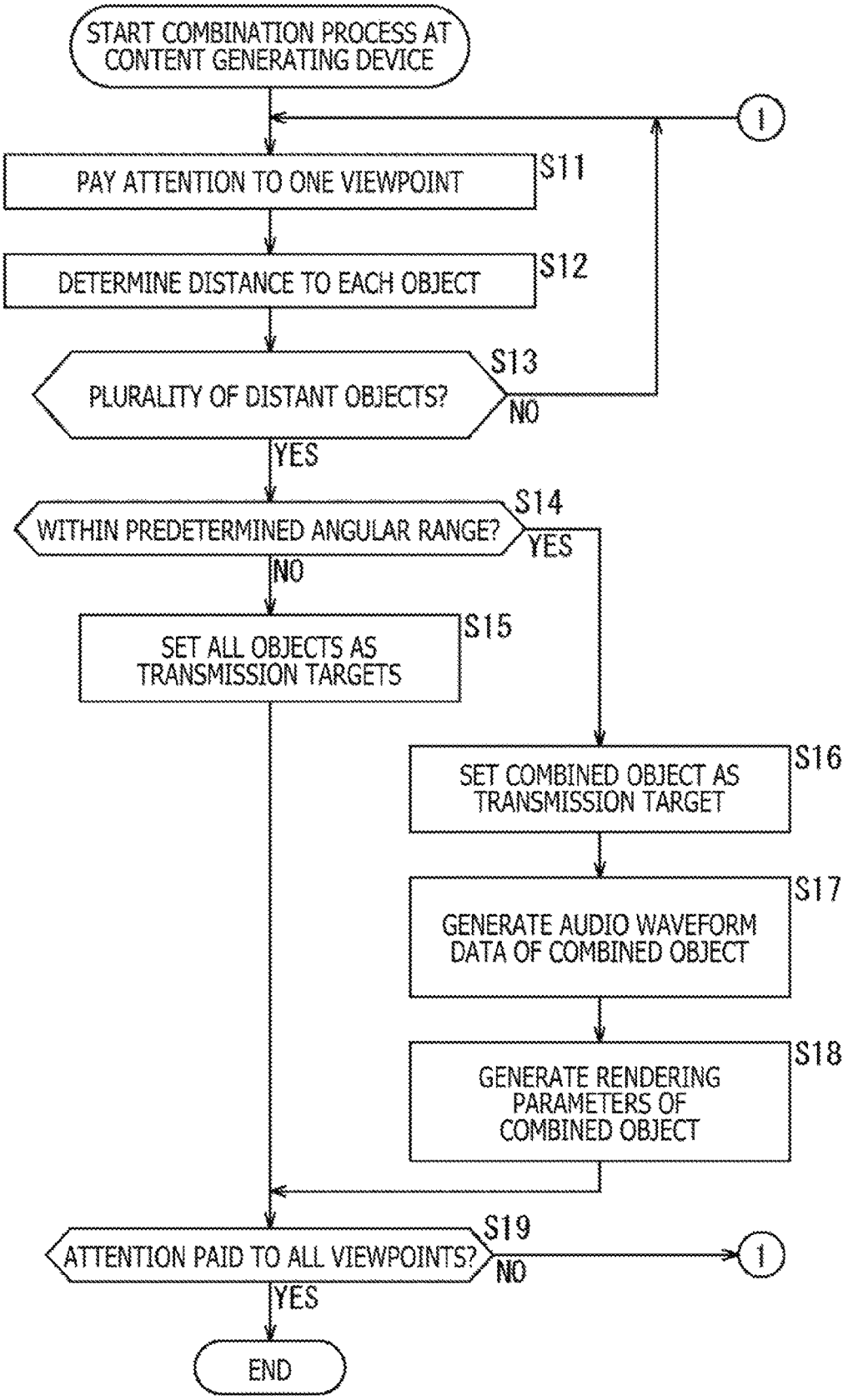
FIG. 13 is a flowchart for explaining a combination process performed by the content generating device.

For example, the processes illustrated in FIG. 13 are performed at a predetermined timing after a set of audio waveform data of each of the objects, the bass, drums, guitar 1, guitar 2, and vocal, and rendering parameters of each object for each viewpoint is generated.

At Step S11, the combining unit 61 pays attention to a predetermined one viewpoint among a plurality of viewpoints for which rendering parameters are generated.

At Step S12, based on parameter information included in rendering parameters, the combining unit 61 identifies the position of each object, and determines the distance to each object as measured from the viewpoint to which attention is being paid as the reference position.

At Step S13, the combining unit 61 determines whether or not there is a plurality of objects far from the viewpoint to which attention is being paid. For example, objects at positions which are at distances equal to or longer than a distance preset as a threshold are treated as distant objects. If it is determined at Step S13 that there are not a plurality of distant objects, the flow returns to Step S11, and the processes mentioned above are repeated while viewpoints to which attention is paid are switched.

On the other hand, if it is determined at Step S13 there is a plurality of distant objects, the process advances to Step S14. If the viewpoint 2 is selected as a viewpoint to which attention is being paid, for example, the drums, guitar 1, and guitar 2 are determined as distant objects.

At Step S14, the combining unit 61 determines whether or not the plurality of distant objects is within a predetermined horizontal angular range. That is, in this example, objects that are far from a viewpoint, and within a predetermined horizontal angular range from the viewpoint are processed as objects with undistinguishable sounds.

If it is determined at Step S14 that the plurality of distant objects is not within the predetermined horizontal angular range, at Step S15, the combining unit 61 sets all the objects as transmission targets for the viewpoint to which attention is being paid. In this case, if the viewpoint to which attention is being paid is selected at the time of content transmission, similar to the case where the viewpoint 1 is selected as mentioned above, audio waveform data of all the objects and rendering parameters of each object of the viewpoint are transmitted.

On the other hand, if it is determined at Step S14 that the plurality of distant objects is within the predetermined horizontal angular range, at Step S16, the combining unit 61 merges the plurality of distant objects within the predetermined horizontal angular range, and sets the combined object to a transmission target. In this case, if the viewpoint to which attention is being paid is selected at the time of content transmission, audio waveform data and rendering parameters of the combined object are transmitted along with audio waveform data and rendering parameters of uncombined, independent objects.

At Step S17, the combining unit 61 determines the sum of audio waveform data of the distant objects within the predetermined horizontal angular range to thereby generate audio waveform data of the combined object. This process is equivalent to the process of a calculation of Math (5) illustrated above.

At Step S18, the combining unit 61 determines the average of rendering parameters of the distant objects within the predetermined horizontal angular range to thereby generate rendering parameters of the combined object. This process is equivalent to the process of a calculation of Math (6) illustrated above.

The audio waveform data and rendering parameters of the combined object are stored in the content storage unit 55, and are managed as data to be transmitted when the viewpoint to which attention is being paid is selected.

After the transmission target is set at Step S15, or after the rendering parameters of the combined object are generated at Step S18, at Step S19, the combining unit 61 determines whether or not attention has been paid to all the viewpoints. If it is determined at Step S19 that there is a viewpoint to which attention has not been paid, the flow returns to Step S11, and the processes mentioned above are repeated while viewpoints to which attention is paid are switched.

On the other hand, if it is determined at Step S19 that attention has been paid to all the viewpoints, the processes illustrated in FIG. 13 are ended.

With the processes mentioned above, objects with sounds that are undistinguishable from a viewpoint are merged into a combined object.

The processes illustrated in FIG. 13 may be performed in response to sending of selection viewpoint information from the reproduction device 2. In this case, the processes illustrated in FIG. 13 are performed using a viewpoint selected by a user as a viewpoint to which attention is being paid, and combination of objects is performed as appropriate.

Not objects that are far from the viewpoint and within a predetermined horizontal angular range as seen from the viewpoint, but simply objects that are far from the viewpoint may be processed as objects with undistinguishable sounds. In addition, objects that are within a predetermined horizontal angular range as seen from the viewpoint may be processed as objects with undistinguishable sounds.

Distances between objects may be calculated, and objects with a distance therebetween which is shorter than a threshold distance may be merged into a combined object.

If the amount of components of audio waveform data of one object that masks audio waveform data of another object is larger than a threshold, those objects may be processed as objects with undistinguishable sounds. In this manner, the manner of determination about objects with undistinguishable sounds may be arbitrary.

Content Transmission Processes

Next, processes performed by the content generating device 1 to transmit contents are explained with reference to the flowchart illustrated in FIG. 14.

Figure 14:
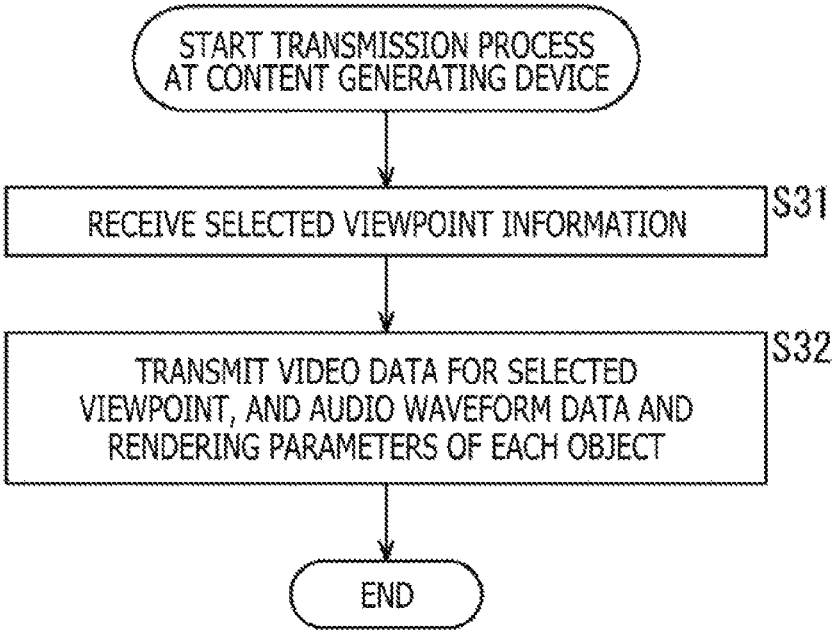
FIG. 14 is a flowchart for explaining a transmission process performed by the content generating device.

For example, the processes illustrated in FIG. 14 are started when the reproduction device 2 requests the start of content transmission, and selection viewpoint information is sent from the reproduction device 2.

At Step S31, the transmission control unit 56 receives the selection viewpoint information sent from the reproduction device 2.

At Step S32, the transmission control unit 56 read outs, from the content storage unit 55, video data for a viewpoint selected by a user of the reproduction device 2, and audio waveform data and rendering parameters of each object for the selected viewpoint, and transmit them. For objects that are combined, audio waveform data and rendering parameters generated for audio data of a combined object are transmitted.

The processes mentioned above are performed repeatedly until content transmission is ended. When the content transmission is ended, the processes illustrated in FIG. 14 are ended.

<Operations of Reproduction Device 2>

Figure 15:
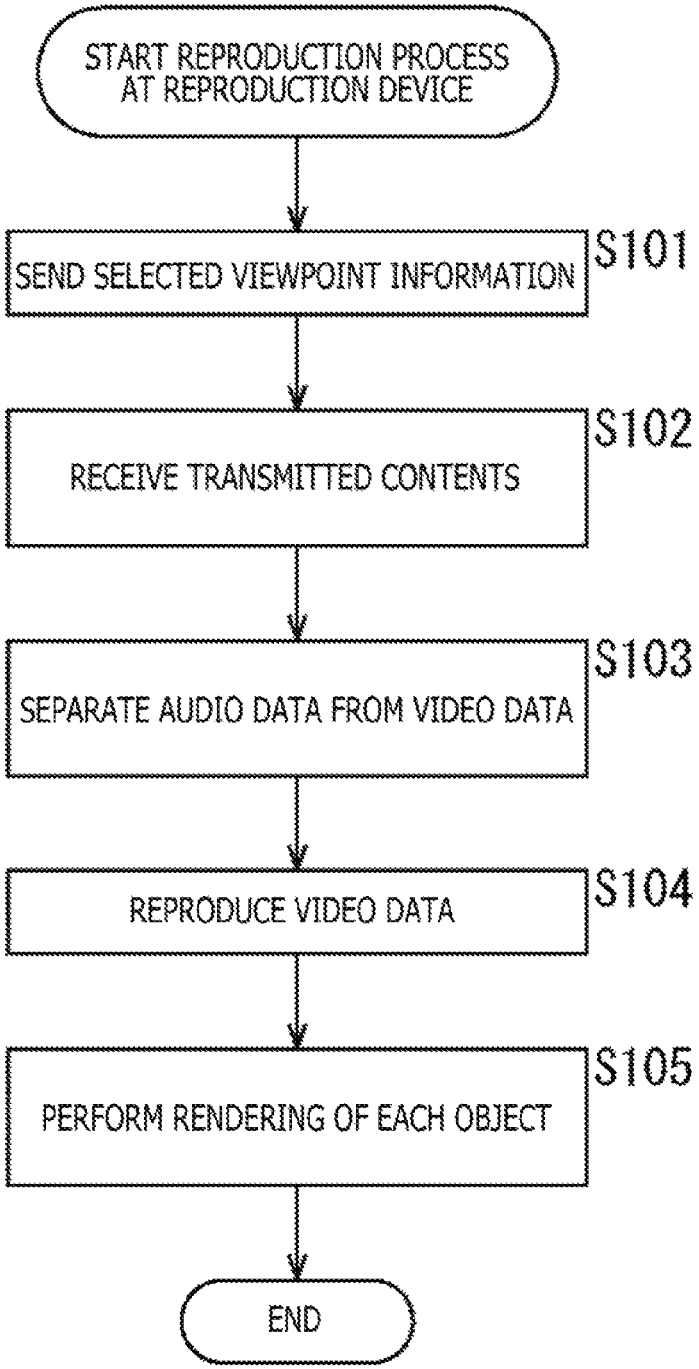
FIG. 15 is a flowchart for explaining a reproduction process performed by the reproduction device.

Next, processes performed by the reproduction device 2 to reproduce contents are explained with reference to the flowchart illustrated in FIG. 15.

At Step S101, the content acquiring unit 71 sends information representing a viewpoint selected by a user to the content generating device 1 as selection viewpoint information.

For example, before viewing and listening of contents is started, a screen to be used for selecting from which viewpoint among a plurality of prepared viewpoints contents are to be viewed and listened to is displayed based on information sent from the content generating device 1. In response to sending of selection viewpoint information, the content generating device 1 sends contents including video data and audio data for a viewpoint selected by a user.

At Step S102, the content acquiring unit 71 receives and acquires the contents sent from the content generating device 1.

At Step S103, the separating unit 72 separates the video data and audio data included in the contents.

At Step S104, the video reproduction unit 74 decodes the video data supplied from the separating unit 72, and makes a video of contents as seen from a predetermined viewpoint displayed on a display.

At Step S105, based on rendering parameters of each object, the audio reproduction unit 73 performs rendering of audio waveform data of each object included in the audio data supplied from the separating unit 72, and makes sounds output from a speaker.

The processes mentioned above are performed repeatedly until content reproduction is ended. When the content reproduction is ended, the processes illustrated in FIG. 15 are ended.

A series of processes mentioned above can reduce the number of objects to be transmitted, and can reduce the data transmission amount.

<<Modification Examples of Manner of Merging Objects>>

(1) Manner of Merging according to Transmission Bit Rate

The maximum number of objects may be decided according to the transmission bit rate, and objects may be merged such that the number of the objects does not exceed the maximum number.

Figure 16:
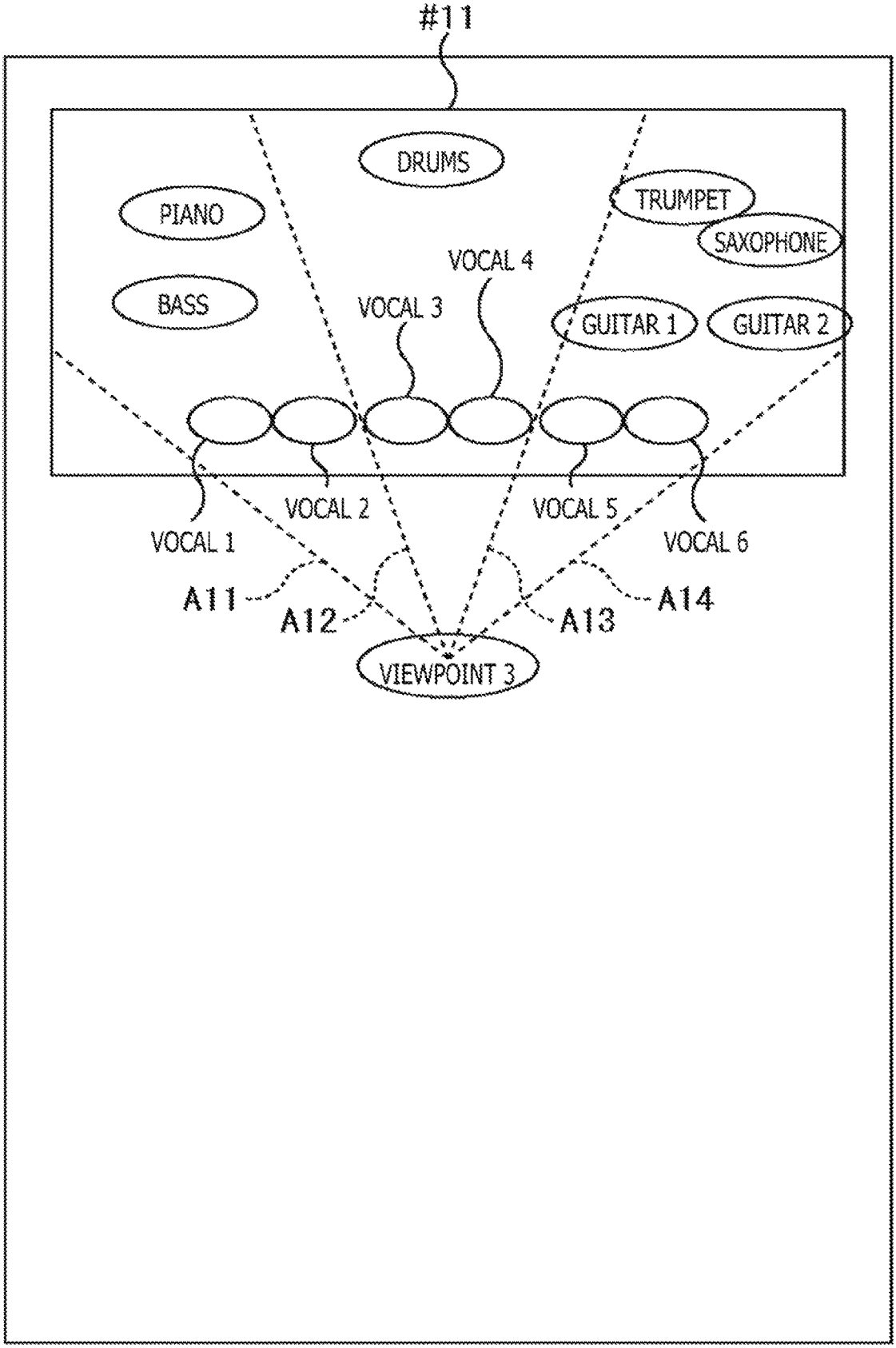
FIG. 16 is a figure illustrating another exemplary arrangement of objects.

FIG. 16 is a figure illustrating another exemplary arrangement of objects. FIG. 16 illustrates an example of a performance by a bass, drums, a guitar 1, a guitar 2, vocals 1 to 6, a piano, a trumpet, and a saxophone. In the example illustrated in FIG. 16, a viewpoint 3 for viewing the stage #11 from the front is set.

For example, if the maximum number of objects according to a transmission bit rate is three, and the viewpoint 3 is selected, the piano, bass, vocal 1, and vocal 2 are merged into a first object based on determination according to angles like the one mentioned above. The piano, bass, vocal 1, and vocal 2 are objects within an angular range between a broken line A11 and a broken line A12 set for the left side of the stage #11 as seen from the viewpoint 3 as the reference position.

Similarly, the drums, vocal 3, and vocal 4 are merged into a second object. The drums, vocal 3, and vocal 4 are objects within an angular range between the broken line A12 and a broken line A13 set for the middle of the stage #11.

In addition, the trumpet, saxophone, guitar 1, guitar 2, vocal 5, and vocal 6 are merged into a third object. The trumpet, saxophone, guitar 1, guitar 2, vocal 5, and vocal 6 are objects within an angular range between the broken line A13 and a broken line A14 set for the right side of the stage #11.

In the manner mentioned above, audio waveform data and rendering parameters of each object (combined object) are generated, and audio data of three objects is transmitted. The number of combined objects into which objects are merged in this manner can be set to three or larger.

Figure 17:
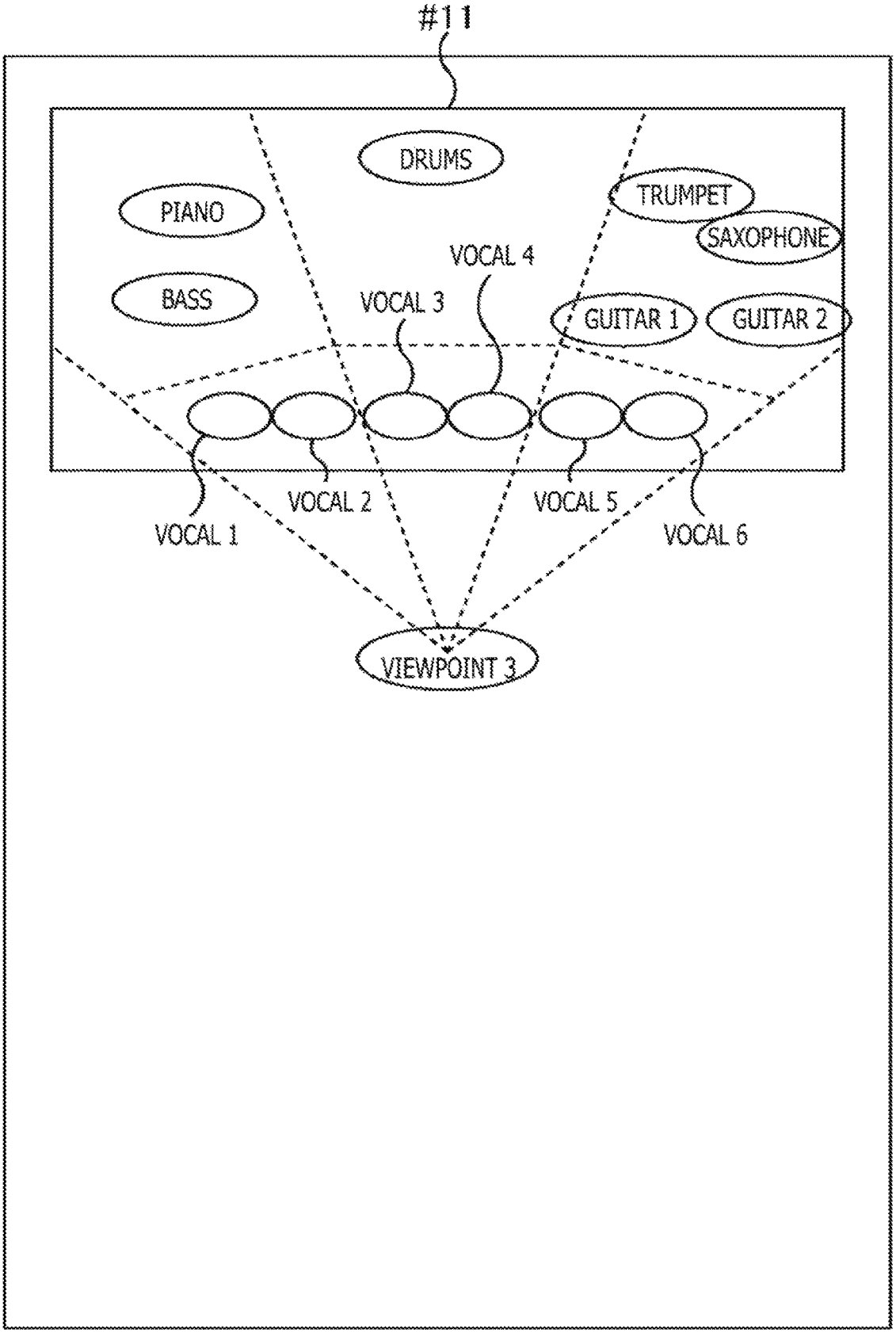
FIG. 17 is a figure illustrating another exemplary manner of merging objects.

FIG. 17 is a figure illustrating another exemplary manner of merging objects. For example, if the maximum number of objects according to a transmission bit rate is six, and the viewpoint 3 is selected, individual objects are merged as illustrated by sectioning using broken lines in FIG. 17 based on determination according to angles and distances like the ones mentioned above.

In the example illustrated in FIG. 17, the piano and bass are merged into a first object, and the vocal 1 and vocal 2 are merged into a second object. In addition, the drums are treated as an independent third object, and the vocal 3 and vocal are merged into a fourth object. The trumpet, saxophone, guitar 1, and guitar 2 are merged into a fifth object, and the vocal 5 and vocal 6 are merged into a sixth object.

The manner of merging illustrated in FIG. 16 is a manner of merging selected in the case where the transmission bit rate is low as compared with that when the manner of merging illustrated in FIG. 17 is employed.

By deciding the number of objects to be transmitted according to the transmission bit rate, viewing and listening with high-quality sound is allowed in the case where the transmission bit rate is high, and viewing and listening with low-quality sound is allowed in the case where the transmission bit rate is low, thus enabling content transmission at sound quality corresponding to the transmission bit rate.

For example, as audio data to be transmitted in the case where the viewpoint 3 is selected, the content storage unit 55 of the content generating device 1 stores audio data of the three objects as illustrated in FIG. 16, and audio data of the six objects as illustrated in FIG. 17.

The transmission control unit 56 categorizes the communication environment of the reproduction device 2 before content transmission is started, and performs the transmission by selecting either the audio data of the three objects or the audio data of the six objects according to the transmission bit rate.

(2) Grouping of Objects

Although in the examples mentioned above, rendering information is gains, it may be reverb information. Among parameters constituting reverb information, an important parameter is reverberation amount. Reverberation amount is an amount of components of spatial reflection at walls, a floor, and the like. The reverberation amount varies depending on distances between objects (musical instruments) and a viewer/listener. Typically, the shorter the distance is, the smaller reverberation amount is, and the longer the distance is, the larger the reverberation amount is.

Other than judging whether or not sounds are distinguishable based on distances or angles to merge objects, distances between objects may be used as another index to merge objects. An example in which objects are merged also taking distances between objects into consideration is illustrated in FIG. 18.

Figure 18:
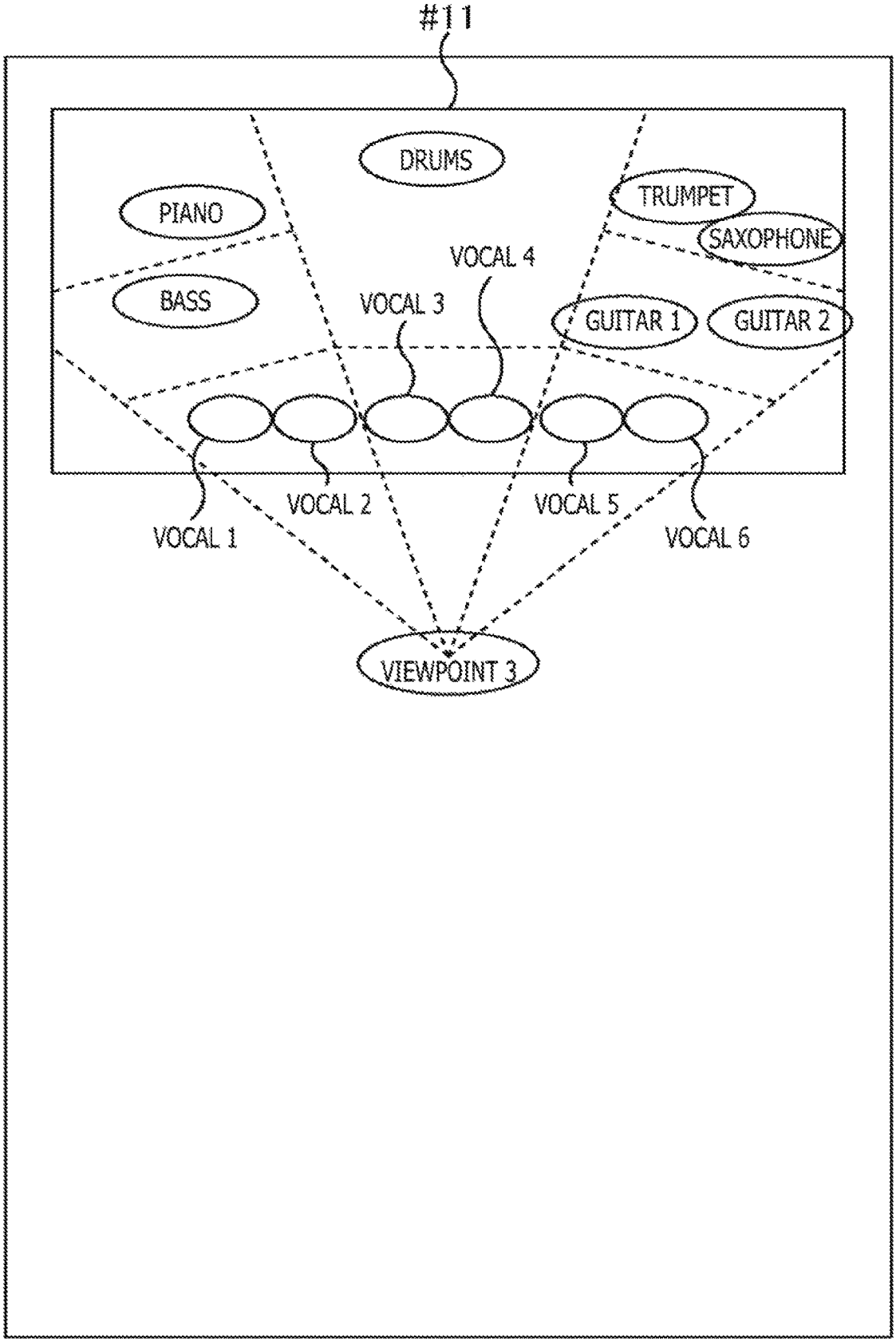
FIG. 18 is a figure illustrating still another exemplary manner of merging objects.

In the example illustrated in FIG. 18, objects are grouped as illustrated by sectioning using broken lines, and objects belonging to each group are merged. Objects belonging to each group are as follows:

Group 1: vocal 1 and vocal 2
Group 2: vocal 3 and vocal 4
Group 3: vocal 5 and vocal 6
Group 4: bass
Group 5: piano
Group 6: drums
Group 7: guitars 1 and 2
Group 8: trumpet and saxophone In this case, as audio data to be transmitted in the case where the viewpoint 3 is selected, the content storage unit 55 of the content generating device 1 stores audio data of the eight objects.

In this manner, even objects that are within an angular range in which sounds are undistinguishable may be processed as objects to which different reverb is applied.

In this manner, it is possible to set in advance a group consisting of objects that can be merged. Only objects that satisfy conditions like the ones mentioned above based on distances and angles, and belong to the same group are to be merged into a combined object.

A group may be set according not only to distances between objects, but also to the types of objects, the positions of objects, and the like.

Note that rendering information may be not only gains or reverb information, but also equalizer information, compressor information or reverb information. That is, rendering information r can be information representing at least any one of gains, equalizer information, compressor information, and reverb information.

(3) Enhancement of Efficiency of Object Audio Encoding

In the example explained below, objects of two stringed instruments are merged into one stringed instrument object. The one stringed instrument object as a combined object is allocated a new object type (obj_type).

If it is supposed that audio waveform data of a violin 1 and audio waveform data of a violin 2 which are objects to be merged are x(n, 10) and x(n, 11), respectively, audio waveform data x(n, 14) of the stringed instrument object as a combined object is represented by Math (7) illustrated below:

[Math. 7]

$$x(n,14)=x(n,10)+x(n,11) \tag{7}$$

Here, since the violin 1 and the violin 2 are the same stringed instruments, the two pieces of audio waveform data are highly correlated.

The difference component x(n, 15) of the audio waveform data of the violin 1 and the violin 2 indicated by Math (8) illustrated below has low information entropy, and requires only a low bit rate in case of being encoded.

[Math. 8]

$$x(n,15)=x(n,10)-x(n,11) \tag{8}$$

By transmitting the difference component x(n, 15) indicated by Math (8) along with the audio waveform data x(n, 14) represented as the sum component, high-quality sounds can be realized at a low bit rate as explained below.

It is supposed that normally the content generating device 1 transmits the audio waveform data x(n, 14) to the reproduction device 2. Here, if conversion into high-quality sounds is performed on the reproduction device 2 side, the difference component x(n, 15) is also transmitted.

By performing calculations illustrated by Math (9) and Math (10) illustrated below, the reproduction device 2 having received the difference component x(n, 15) along with the audio waveform data x(n, 14) can reproduce the audio waveform data x(n, 10) of the violin 1 and the audio waveform data x(n, 11) of the violin 2.

[Math. 9]

$$(x(n,14)-x(n,15))/2=(x(n,10)+x(n,11)-x(n,10)+x(n,11))/2=x(n,11) \tag{10}$$

In this case, the content storage unit 55 of the content generating device 1 stores the difference component x(n, 15) along with the audio waveform data x(n, 14) as stringed instrument object audio data to be transmitted if a predetermined viewpoint is selected.

A flag indicating that difference component data is retained is managed at the content generating device 1. The flag is sent from the content generating device 1 to the reproduction device 2 along with other information, for example, and the reproduction device 2 identifies that difference component data is retained.

In this manner, by retaining even a difference component of audio waveform data of highly correlated objects on the content generating device 1 side, it becomes possible to adjust sound quality according to the transmission bit rate at two levels. That is, if the communication environment of the reproduction device 2 is good (if the transmission bit rate is high), the audio waveform data x(n, 14) and the difference component x(n, 15) are transmitted, and if the communication environment is not good, only the audio waveform data x(n, 14) is transmitted.

Note that the amount of data of the sum of the audio waveform data x(n, 14) and the difference component x(n, 15) is smaller than the amount of data of the sum of the audio waveform data x(n, 10) and x(n, 11).

Also if the number of objects is four, the objects can be merged similarly. If four musical instruments are merged, the audio waveform data x(n, 14) of the merged object is represented by Math (11) illustrated below:

[Math. 11]

$$x(n,14)=x(n,10)+x(n,11)+x(n,12)+x(n,13) \tag{11}$$

Here, x(n, 10), x(n, 11), x(n, 12), and x(n, 13) are audio waveform data of the violin 1, audio waveform data of the violin 2, audio waveform data of the violin 3, and audio waveform data of the violin 4, respectively.

In this case, the difference component data represented by Maths (12) to (14) illustrated below is retained by the content generating device 1.

[Math. 12]

$$x(n,15)=x(n,10)+x(n,11)-x(n,12)-x(n,13) \tag{12}$$

[Math. 13]

$$x(n,16)=x(n,10)-x(n,11)+x(n,12)-x(n,13) \tag{13}$$

[Math. 14]

$$x(n,17)=x(n,10)-x(n,11)-x(n,12)+x(n,13) \tag{14}$$

It is supposed that normally the content generating device 1 transmits the audio waveform data x(n, 14) to the reproduction device 2. Here, if conversion into high-quality sounds is performed on the reproduction device 2 side, the difference components x(n, 15), x(n, 16), and x(n, 17) are also transmitted.

By performing calculations illustrated by Maths (15) to (18) below, the reproduction device 2 having received the difference components x(n, 15), x(n, 16), and x(n, 17) along with the audio waveform data x(n, 14) can reproduce the audio waveform data x(n, 10) of the violin 1, the audio waveform data x(n, 11) of the violin 2, the audio waveform data x(n, 12) of the violin 3, and the audio waveform data x(n, 13) of the violin 4.

[Math. 15]

$$(x(n,14)+x(n,15)+x(n,16)+x(n,17))/4=x(n,10) \tag{15}$$

[Math. 16]

$$(x(n,14)+x(n,15)-x(n,16)-x(n,17))/4=x(n,11) \tag{16}$$

[Math. 17]

$$(x(n,14)-x(n,15)+x(n,16)-x(n,17))/4=x(n,12) \tag{17}$$

[Math. 18]

$$(x(n,14)-x(n,15)-x(n,16)+x(n,17))/4=x(n,13) \tag{18}$$

Furthermore, it can be known from Math (19) illustrated below that if there are the audio waveform data x(n, 14) and the difference component x(n, 15), the sum (x(n, 10)+x(n, 11)) of the audio waveform data of the violin 1 and the audio waveform data of the violin 2 can be acquired. In addition, it can be known from Math (20) illustrated below that if there are the audio waveform data x(n, 14) and the difference component x(n, 15), the sum (x(n, 12)+x(n, 13)) of the audio waveform data of the violin 3 and the audio waveform data of the violin 4 can be acquired.

[Math. 19]

$$(x(n,14)+x(n,15))/2=x(n,10)+x(n,11) \quad (19)$$

[Math. 20]

$$x(n,14)-x(n,15))/2=x(n,12)+x(n,13) \quad (20)$$

For example, if the transmission bit rate that the reproduction device 2 can support is higher than a first threshold, and the communication environment is the best among three levels, the difference components x(n, 15), x(n, 16), and x(n, 17) are transmitted from the content generating device 1 along with the audio waveform data x(n, 14) obtained by merging the four objects.

Calculations illustrated by Maths (15) to (18) are performed at the reproduction device 2, audio waveform data of individual objects, the violin 1, violin 2, violin 3, and violin 4, is acquired, and reproduction is performed with high quality.

In addition, if the transmission bit rate that the reproduction device 2 can support is lower than the first threshold mentioned above, but is higher than a second threshold, and the communication environment is relatively good, the difference component x(n, 15) is transmitted from the content generating device 1 along with the audio waveform data x(n, 14) obtained by merging the four objects.

Calculations illustrated by Math (19) and Math (20) are performed at the reproduction device 2, audio waveform data obtained by merging the violin 1 and violin 2, and audio waveform data obtained by merging the violin 3 and violin 4 are acquired, and reproduction is performed with higher quality than that performed in the case where only the audio waveform data x(n, 14) is used.

If the transmission bit rate that the reproduction device 2 can support is lower than the second threshold mentioned above, the audio waveform data x(n, 14) obtained by merging the four objects is transmitted from the content generating device 1.

In this manner, hierarchical transmission (encoding) according to a transmission bit rate may be performed by the content generating device 1.

Such hierarchical transmission may be performed according to a fee paid by a user of the reproduction device 2. For example, if the user paid a normal fee, transmission of only the audio waveform data x(n, 14) is performed, and if the user paid a fee higher than the normal fee, transmission of the audio waveform data x(n, 14) and a difference component is performed.

(4) Cooperation with Point Cloud Moving Image Data

It is supposed that video data of contents transmitted by the content generating device 1 is point cloud moving image data. Both point cloud moving image data and object audio data have data about coordinates in a three-dimensional space, and serve as color data and audio data at those coordinates.

Note that point cloud moving image data is disclosed, for example, at "Microsoft "A Voxelized Point Cloud Dataset," <https://jpeg.org/plenodb/pc/microsoft/>."

The content generating device 1 retains a three-dimensional coordinate as information about the position of a vocal, for example, and in association with the coordinate, retains point cloud moving image data and audio object data. Thereby, the reproduction device 2 can easily acquire point cloud moving image data and audio object data of a desired object.

Modification Examples

An audio bitstream transmitted by the content generating device 1 may include flag information indicating whether or not an object being transmitted by the stream is an unmerged independent object or a combined object. An audio bitstream including flag information is illustrated in FIG. 19.

Figure 19:
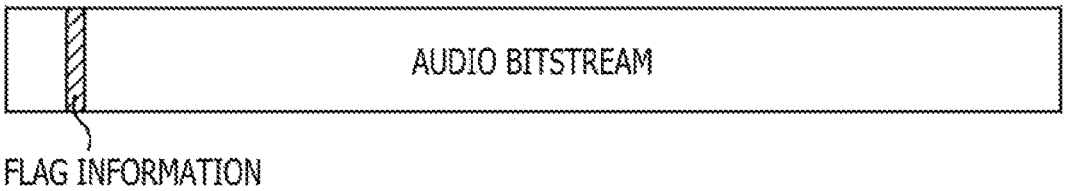
FIG. 19 is a figure illustrating exemplary transmission of flag information.

The audio bitstream illustrated in FIG. 19 also includes audio waveform data and rendering parameters of an object, for example.

The flag information illustrated in FIG. 19 may be information indicating whether or not an object being transmitted by the stream is an independent object, or information indicating whether or not the object being transmitted is a combined object.

Thereby, by analyzing the stream, the reproduction device 2 can identify whether data included in the stream is data of a combined object or data of an independent object.

Figure 20:
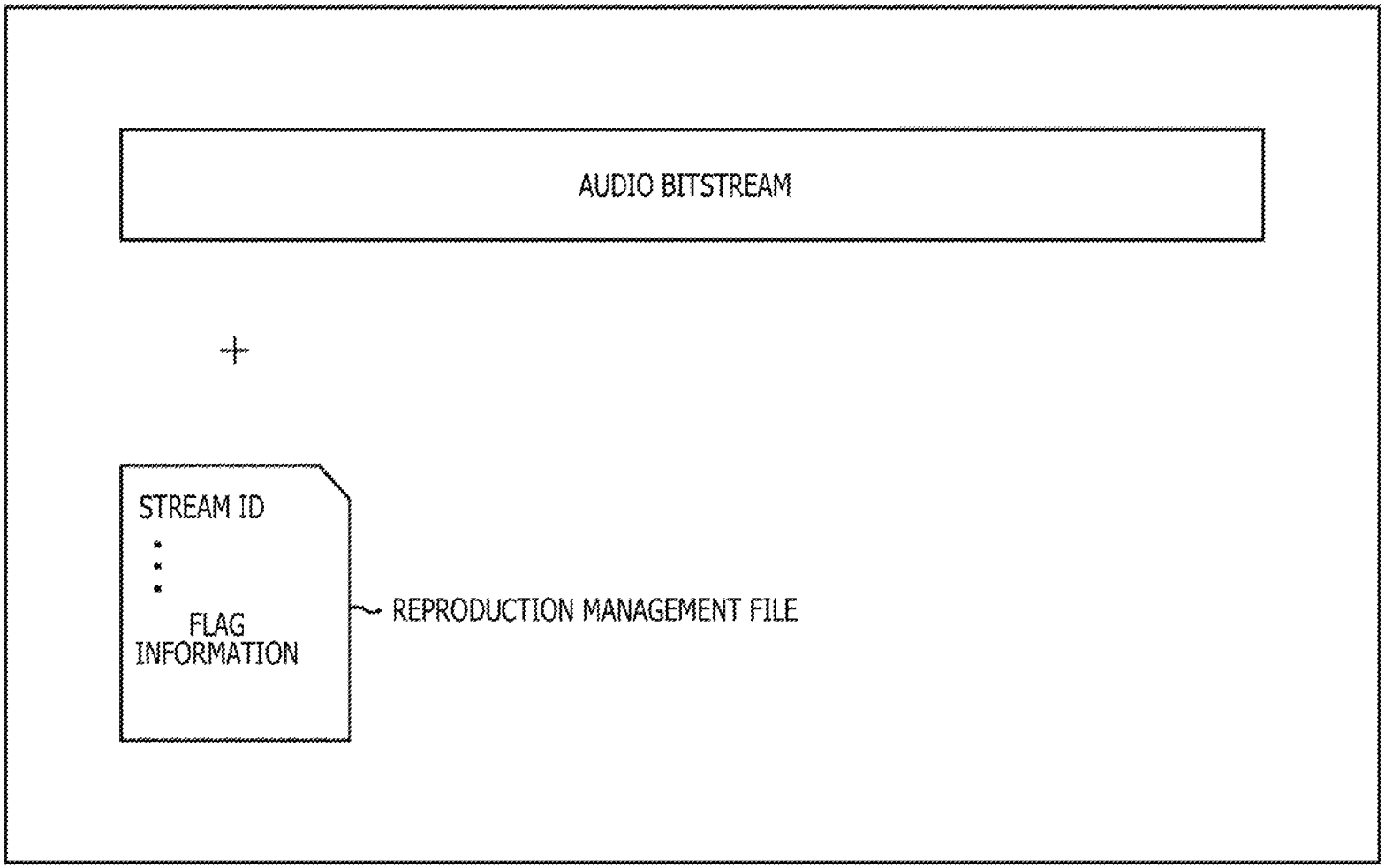
FIG. 20 is a figure illustrating other exemplary transmission of flag information.

Such flag information may be described in a reproduction management file transmitted along with a bitstream as illustrated in FIG. 20. The reproduction management file also describes information such as a stream ID of a stream which is a target of reproduction of the reproduction management file (a stream to be reproduced by using the reproduction management file). This reproduction management file may be configured as an MPD (Media Presentation Description) file in MPEG-DASH.

Thereby, by referring to the reproduction management file, the reproduction device 2 can identify whether an object being transmitted by the stream is a combined object or an independent object.

Although it is explained that contents to be reproduced by the reproduction device 2 includes video data and object-based audio data, the contents may not include video data, but may consist of object-based audio data. If a predetermined listening position is selected from listening positions for which rendering parameters are prepared, rendering parameters for the selected listening position are used to reproduce each audio object.

Embodiments of the present technology are not limited to the embodiment mentioned above, but can be changed in various manners within a scope that does not deviate from the gist of the present technology.

For example, the present technology can have a configuration of cloud computing in which a plurality of devices shares one function via a network, and performs processes in cooperation with each other.

In addition, individual steps explained in the flowcharts mentioned above can be executed by one device, or may be executed by a plurality of devices in a shared manner.

Furthermore, if one step includes a plurality of processes, the plurality of processes included in the one step can be executed by one device, or may be executed by a plurality of devices in a shared manner.

Advantages described in the present specification are illustrated merely as examples, advantages are not limited to them, and there may be other advantages.

About Program

The series of processes mentioned above can be executed by hardware, and can also be executed by software. If the series of processes is executed by software, a program constituting the software is installed on a computer incorporated into dedicated hardware, a general-purpose personal computer, or the like.

The program to be installed is provided as a program recorded in the removable media 31 illustrated in FIG. 9 constituted by an optical disc (CD-ROM) (Compact Disc-Read Only Memory), DVD (Digital Versatile Disc), etc.), a semiconductor memory, and the like. In addition, it may be provided via wireless or wired transmission medium such as a local area network, the Internet, or digital broadcasting. The program can be installed in advance in the ROM 22 or the storage unit 28.

Note that the program to be executed by a computer may be a program to perform processes in a temporal sequence along the order explained in the present specification, or may be a program that performs processes in parallel, or at required timings when the processes are called or at different timings.

About Combinations

The present technology can also be configured in the following manners.

(1) An information processing device including:

a combining unit that combines audio objects with sounds that are undistinguishable at a predetermined supposed listening position from among a plurality of audio objects for the predetermined supposed listening position among a plurality of supposed listening positions; and a transmitting unit that transmits data of a combined audio object obtained by the combination, along with data of other audio objects with sounds that are distinguishable at the predetermined supposed listening position.

(2) The information processing device according to (1) explained above, in which based on audio waveform data and rendering parameters of a plurality of audio objects to be targets of the combination, the combining unit generates audio waveform data and a rendering parameter of the combined audio object.

(3) The information processing device according to (2) explained above, in which the transmitting unit transmits, as the data of the combined audio object, the audio waveform data and the rendering parameter that are generated by the combining unit, and transmits, as the data of the other audio objects, audio waveform data of each of the other audio objects and a rendering parameter for the predetermined supposed listening position.

(4) The information processing device according to any one of (1) to (3) explained above, in which the combining unit combines a plurality of audio objects at positions that are away from the predetermined supposed listening position by distances which are equal to or longer than a predetermined distance.

(5) The information processing device according to any one of (1) to (4) explained above, in which the combining unit combines a plurality of audio objects that is within a horizontal angle range narrower than a predetermined angle as measured from the predetermined supposed listening position as a reference position.

(6) The information processing device according to any one of (1) to (5) explained above, in which the combining unit combines audio objects with sounds that are undistinguishable at the predetermined supposed listening position and belong to a same preset group.

(7) The information processing device according to any one of (1) to (6) explained above, in which the combining unit performs audio object combination such that the number of audio objects to be transmitted becomes the number corresponding to a transmission bit rate.

(8) The information processing device according to any one of (1) to (7) explained above, in which the transmitting unit transmits an audio bitstream including flag information representing whether an audio object included in the audio bitstream is an uncombined audio object or the combined audio object.

(9) The information processing device according to any one of (1) to (7) explained above, in which the transmitting unit transmits an audio bitstream file along with a reproduction management file including flag information representing whether an audio object included in the audio bitstream is an uncombined audio object or the combined audio object.

(10) An information processing method including steps of:

combining audio objects with sounds that are undistinguishable at a predetermined supposed listening position from among a plurality of audio objects for the predetermined supposed listening position among a plurality of supposed listening positions; and transmitting data of a combined audio object obtained by the combination, along with data of other audio objects with sounds that are distinguishable at the predetermined supposed listening position.

(11) A program for making a computer execute processing including steps of:

combining audio objects with sounds that are undistinguishable at a predetermined supposed listening position from among a plurality of audio objects for the predetermined supposed listening position among a plurality of supposed listening positions; and transmitting data of a combined audio object obtained by the combination, along with data of other audio objects with sounds that are distinguishable at the predetermined supposed listening position.

REFERENCE SIGNS LIST

1: Content generating device, 2: Reproduction device, 51: Audio encoder, 52: Metadata encoder, 53: Audio generating unit, 54: Video generating unit, 55: Content storage unit, 56: Transmission control unit, 61: Combining unit, 71: Content acquiring unit, 72: Separating unit, 73: Audio reproduction unit, 74: Video reproduction unit, 73: Audio reproduction unit

The invention claimed is:

1. An information processing device, comprising:

a combining unit configured to:

determine a first set of audio objects from a plurality of audio objects for a listening position of a plurality of listening positions, wherein the first set of audio objects is determined based on a distance of each audio object of the first set of audio objects from the listening position, and the distance is equal to or greater than a first threshold distance;

combine the first set of audio objects as a combined audio object, wherein the first set of audio objects is associated with sounds that are undistinguishable at the listening position;

generate data of the combined audio object based on the combination of the first set of audio objects; and a transmitting unit configured to transmit the generated data of the combined audio object along with data of a second set of audio objects of the plurality of audio objects, wherein sounds associated with the second set of audio objects are distinguishable at the listening position.

2. The information processing device according to claim 1, wherein based on audio waveform data of the first set of audio objects and rendering parameters of the first set of audio objects, the combining unit is further configured to generate audio waveform data of the combined audio object and a rendering parameter of the combined audio object.

3. The information processing device according to claim 2, wherein the transmitting unit is further configured to:

transmit, as the data of the combined audio object, the audio waveform data of the combined audio object and the rendering parameter of the combined audio object that are generated by the combining unit; and transmit, as the data of the second set of audio objects, audio waveform data of each audio object of the second set of audio objects and a rendering parameter of each audio object of the second set of audio objects for the listening position.

4. The information processing device according to claim 1, wherein the first set of audio objects is within a horizontal angle range narrower than a specific angle as measured from the listening position as a reference position.

5. The information processing device according to claim 1, wherein each object of the first set of audio objects belongs to a same group.

6. The information processing device according to claim 1, wherein the combination of the first set of audio objects is based on a transmission bit rate.

7. The information processing device according to claim 1, wherein the transmitting unit is further configured to transmit an audio bitstream that includes flag information, and the flag information represents inclusion of one of an uncombined audio object or the combined audio object in the audio bit stream.

8. The information processing device according to claim 1, wherein the transmitting unit is further configured to transmit an audio bitstream file along with a reproduction management file, the reproduction management file includes flag information, and the flag information represents inclusion of an uncombined audio object or the combined audio object in the audio bitstream file.

9. The information processing device according to claim 1, wherein the combining unit is further configured to determine the first set of audio objects from the plurality of audio objects based on an object type of each audio object of the first set of audio objects being the same audio object type.

10. The information processing device according to claim 1, wherein the combining unit is further configured to determine the first set of audio objects from the plurality of audio objects based on a distance between each of the first set of audio objects, the distance between each of the first set of audio objects being smaller than a second threshold distance.

11. An information processing method, comprising:

determining a first set of audio objects from a plurality of audio objects for a listening position of a plurality of listening positions, wherein the first set of audio objects is determined based on a distance of each audio object of the first set of audio objects from the listening position, and the distance is equal to or greater than a threshold distance;

combining the first set of audio objects as a combined audio object, wherein the first set of audio objects is associated with sounds that are undistinguishable at the listening position;

generating data of the combined audio object based on the combination of the first set of audio objects; and transmitting the generated data of the combined audio object along with data of a second set of audio objects of the plurality of audio objects, wherein sounds associated with the second set of audio objects are distinguishable at the listening position.

12. A non-transitory computer-readable medium having stored thereon, computer-executable instructions which, when executed by a computer, cause the computer to execute operations, the operations comprising:

determining a first set of audio objects from a plurality of audio objects for a listening position of a plurality of listening positions, wherein the first set of audio objects is determined based on a distance of each audio object of the first set of audio objects from the listening position, and the distance is equal to or greater than a threshold distance;

combining the first set of audio objects as a combined audio object, wherein the first set of audio objects is associated with sounds that are undistinguishable at the listening position;

generating data of the combined audio object based on the combination of the first set of audio objects; and transmitting the generated data of the combined audio object along with data of a second set of audio objects of the plurality of audio objects, wherein sounds associated with the second set of audio objects are distinguishable at the listening position.

* * * * *